US008847153B2

(12) United States Patent
Giles et al.

(10) Patent No.: US 8,847,153 B2
(45) Date of Patent: Sep. 30, 2014

(54) SEGMENTED ION TRAP MASS SPECTROMETER

(75) Inventors: Kevin Giles, Cheshire (GB); Martin Green, Cheshire (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 2005 days.

(21) Appl. No.: 11/722,970

(22) PCT Filed: Jan. 17, 2006

(86) PCT No.: PCT/GB2006/000155

§ 371 (c)(1), (2), (4) Date: Jan. 22, 2008

(87) PCT Pub. No.: WO2006/075189

PCT Pub. Date: Jul. 20, 2006

(65) Prior Publication Data

US 2009/0014637 A1 Jan. 15, 2009

Related U.S. Application Data

(60) Provisional application No. 60/648,673, filed on Jan. 31, 2005, provisional application No. 60/724,999, filed on Oct. 7, 2005, provisional application No. 60/724,818, filed on Oct. 7, 2005.

(30) Foreign Application Priority Data

| | | |
|---|---|---|
| Jan. 17, 2005 | (GB) | 0500842.0 |
| Sep. 30, 2005 | (GB) | 0519922.9 |
| Sep. 30, 2005 | (GB) | 0519944.3 |

(51) Int. Cl.
*H01J 49/00* (2006.01)
*H01J 49/42* (2006.01)

(52) U.S. Cl.
CPC ..... *H01J 49/4235* (2013.01); *H01J 49/4275* (2013.01)
USPC ..... 250/283; 250/281; 250/282

(58) Field of Classification Search
USPC ..... 250/281, 282, 287, 290, 291, 292, 293, 250/283, 286, 294
See application file for complete search history.

(56) References Cited

U.S. PATENT DOCUMENTS

| | | | | |
|---|---|---|---|---|
| 5,089,703 A * | 2/1992 | Schoen et al. | ..... | 250/292 |
| 5,206,506 A * | 4/1993 | Kirchner | ..... | 250/281 |
| 5,783,824 A | 7/1998 | Baba et al. | | |

(Continued)

FOREIGN PATENT DOCUMENTS

| | | |
|---|---|---|
| EP | 1367633 | 12/2003 |
| GB | 2390935 | 1/2004 |

(Continued)

OTHER PUBLICATIONS

Wang, Mingda; "Application of Nonresonance Excitation to Ion Trap Tandem Mass Spectrometry and Selected Ejection Chemical Ionization", Journal of American Society for Mass Spectrometry, Elsevier Science Inc, US, vol. 7, No. 7, Jul. 1996 (Jul. 1996), pp. 668-676.

*Primary Examiner* — Nicole Ippolito
(74) *Attorney, Agent, or Firm* — Diederiks & Whitelaw, PLC

(57) ABSTRACT

An ion guide or ion trap 1 is disclosed comprising a segmented linear ion guide or ion trap. Ions are confined radially within the ion guide or ion trap 1 by the application of an AC or RF voltage to the electrodes. Ions are trapped within an axial quadratic potential well which is oscillated or modulated axially so as to cause ions to be ejected from the ion guide or ion trap 1 in a substantially non-resonant manner.

10 Claims, 11 Drawing Sheets

(56) References Cited

U.S. PATENT DOCUMENTS

| | | | |
|---|---|---|---|
| 6,075,244 | A | 6/2000 | Baba et al. |
| 6,111,250 | A | 8/2000 | Thomson et al. |
| 6,177,668 | B1 | 1/2001 | Hager |
| 6,703,607 | B2 | 3/2004 | Stott et al. |
| 6,744,043 | B2 | 6/2004 | Loboda |
| 6,894,286 | B2 | 5/2005 | Derrick et al. |
| 6,909,089 | B2 | 6/2005 | Londry et al. |
| 7,084,398 | B2 | 8/2006 | Loboda et al. |
| 7,157,698 | B2 | 1/2007 | Makarov et al. |
| 2002/0148959 | A1 | 10/2002 | Weiss et al. |
| 2004/0026614 | A1 | 2/2004 | Bateman et al. |
| 2004/0051038 | A1 | 3/2004 | Taniguchi |
| 2006/0163468 | A1 * | 7/2006 | Wells et al. ..... 250/281 |

FOREIGN PATENT DOCUMENTS

| | | |
|---|---|---|
| JP | 2006/073390 | 3/2006 |
| WO | 2006008537 | 1/2006 |

* cited by examiner

SEGMENTED ION TRAP MASS SPECTROMETER

CROSS REFERENCE TO RELATED APPLICATIONS

This application is the National Stage of International Application No. PCT/GB2006/000155, filed on Jan. 17, 2006, which claims priority to and benefit of U.S. Provisional Patent Application Ser. Nos. 60/648,673, filed on Jan. 31, 2005, 60/724,999, filed on Oct. 7, 2005, and 60/724,818, filed on Oct. 7, 2005, and priority to and benefit of United Kingdom Patent Application Nos. 0500842.0, filed Jan. 17, 2005, 0519922.9, filed Sep. 30, 2005, and 0519944.3, filed Sep. 30, 2005. The entire contents of these applications are incorporated herein by reference.

The present invention relates to an ion guide or ion trap, a mass spectrometer, a method of guiding or trapping ions and a method of mass spectrometry.

Various ion trapping techniques are known in the field of mass spectrometry. Commercially available 3D or Paul ion traps, for example, provide a powerful and relatively inexpensive tool for many different types of organic analysis. 3D or Paul ion traps generally have a cylindrical symmetry and comprise a central cylindrical ring electrode and two hyperbolic end cap electrodes. In operation an RF voltage is applied between the end cap electrodes and the central ring electrode of the form:

$$V_{0\text{-}pk}(t)=V_0\cos(\sigma t)$$

where $V_0$ is the zero to peak voltage of the applied RF voltage and $\sigma$ is the frequency of oscillation of the applied RF voltage.

The physical spacing and shape of the electrodes is such that a quadratic potential is maintained in both the radial and axial directions. Under these conditions ion motion is governed by Mathieu's equation and the various criteria for stable ion trapping are well known to those skilled in the art. The motion of the ions consists of a relatively low frequency component secular motion and a relatively high frequency oscillation or micro-motion which is directly related to the frequency at which the drive voltage is modulated.

Ions may be mass selectively ejected from a 3D or Paul ion trap by: (a) mass selective instability wherein either the amplitude and/or the frequency of the applied RF voltage is altered, (b) by resonance ejection wherein a small supplementary RF voltage is applied to one or both of the end cap or ring electrodes which has the same frequency as the secular frequency of the ions of interest, (c) by application of a DC bias voltage maintained between the ring electrode and the end cap electrodes, or (d) by combinations of the above techniques.

Ions are usually introduced into most commercial 3D or Paul ion traps from an external ion source via a small hole in one of the end cap electrodes. Once within the ion trap, the ions may then be cooled by collisions with a buffer gas to near thermal energies. This has the effect of concentrating the ions towards the centre of the trapping volume of the ion trap. Ions having a specific mass to charge ratio may then be mass selectively ejected from the ion trap. Ejected ions exit the ion trap through a small hole in the end cap electrode opposed to the end cap electrode having an aperture for introducing ions into the ion trap. The ions ejected from the ion trap are then detected using an ion detector.

3D or Paul ion traps suffer from the disadvantage that they possess a relatively limited dynamic range due to the fact that they have a relatively low space charge capacity. Furthermore, extreme care must be taken to ensure that correct conditions are maintained during ion introduction in order to minimize ion losses. As will be understood by those skilled in the art, injecting ions into a 3D Paul ion trap can be particularly problematic.

More recently linear ion traps have been developed and commercialised. Such ion traps generally comprise a multipole rod set wherein ions are confined radially within the ion trap due to the application of a RF voltage to the rods. Ion motion and stability in the radial direction is governed by Mathieu's equation and is well known. Ions may be contained axially within the linear ion trap by the application of a DC or RF trapping potential to electrodes at either end of the multiple rod set. Ion ejection may be accomplished by either ejecting ions radially from the ion trap through a slot in one of the rods or axially by using a combination of radial excitation and inherent field distortions at the axial boundary of the rods.

Linear ion traps generally exhibit increased ion trapping capacities relative to 3D or Paul ion traps and therefore linear ion traps generally exhibit a substantially higher dynamic range. Linear ion traps have an important advantage in that ions may be axially introduced into the ion trap and in some cases axially ejected from the ion trap in a direction which is orthogonal to the radial RF oscillating trapping potential. This enables ions to be transferred more efficiently into and out of the ion trap thereby resulting in improved sensitivity. Linear ion traps are therefore increasingly being preferred to 3D or Paul ion traps due to their increased sensitivity and relatively large ion trapping capacity.

Optimum performance of a linear ion trap which uses radial ejection rather than axial ejection may be achieved using a pure quadrupolar radial potential distribution and accurately shaped hyperbolic rods. However, deviations in the linearity of the radial confining field caused, for example, by mechanical misalignment of the rods can seriously compromise the performance of such a linear ion trap. The provision of slots in the rods of the linear ion trap to facilitate radial ejection can also lead to significant distortions in the radial field. These distortions can further degrade the performance of the linear ion trap. In addition during radial ejection it may be necessary to use more than one ion detector for efficient detection of the ejected ions. This adds to the overall complexity and expense of the ion trap.

It is known to eject ions axially from a linear ion trap. However, the performance of axial ejection of ions from a linear ion trap using fringe fields may also be affected by distortions in the linearity of the radial field. Axial ejection of ions relies upon efficient radial resonance excitation of the ions. If the radial field is non-linear then the resonant frequency will not be constant as the radius of the ion motion increases. Accordingly, the performance of the ion trap in this mode of operation will be compromised. A further problem with axially ejecting ions from a known linear ion trap is that only those ions at or close to the exit fringe field will actually be ejected from the ion trap. Accordingly, the theoretical gains in dynamic range and sensitivity of a linear ion trap relative to a 3D or Paul ion trap may be reduced in practice due to the relatively small region from which ions may actually be ejected from.

U.S. Pat. No. 5,783,824 (Hitachi) discloses a linear ion trap wherein an axial DC or electrostatic field is maintained along the length of the ion trap. Ions are ejected axially by resonance excitation by the application of a supplementary axial RF potential which oscillates at the fundamental harmonic frequency of the ions which are desired to be ejected. This known linear ion trap has the general advantages of other forms of linear ion trap but in addition forces ions to oscillate axially with a frequency characteristic of their mass to charge ratio. This facilitates axial resonance ejection of ions from the ion trap.

The linear ion trap disclosed in U.S. Pat. No. 5,783,824 uses resonance excitation to axially eject ions at the fundamental frequency of simple harmonic oscillation determined by an axial quadratic DC or electrostatic potential. However, with the arrangement disclosed in U.S. Pat. No. 5,783,824 any deviations from a true quadratic axial DC or electrostatic potential will result in the frequency of oscillation of the ions being dependent upon the amplitude of oscillation of the ions. This will compromise the performance of the ion trap using resonance ejection.

It is therefore derived to provide an improved ion trap or ion guide.

According to an aspect of the present invention there is provided an ion guide or ion trap comprising:

a plurality of electrodes;

AC or RF voltage means arranged and adapted to apply an AC or RF voltage to at least some of the plurality of electrodes in order to confine radially at least some ions within the ion guide or ion trap;

first means arranged and adapted to maintain one or more substantially quadratic potential wells along at least a portion of the axial length of the ion guide or ion trap in a first mode of operation, the one or more substantially quadratic potential wells having a minimum;

modulation means arranged and adapted to modulate or oscillate the position of the one or more substantially quadratic potential wells and/or the position of the minimum of the one or more substantially quadratic potential wells along at least a portion of the axial length of the ion guide or ion trap; and ejection means arranged and adapted in the first mode of operation to eject at least some ions from a trapping region of the ion guide or ion trap in a substantially non-resonant manner whilst other ions are arranged to remain substantially trapped within the trapping region of the ion guide or ion trap.

The AC or RF voltage means is preferably arranged and adapted to apply an AC or RF voltage to at least 1%, 5%, 10%, 20%, 30%, 40%, 50%, 60%, 70%, 80%, 90%, 95% or 100% of the plurality of electrodes. According to a preferred embodiment the AC or RF voltage means is arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. Preferably, the AC or RF voltage means is arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to a preferred embodiment the first means is arranged and adapted to maintain at least 1, 2, 3, 4, 5, 6, 7, 8, 9, 10 or >10 substantially quadratic potential wells along at least a portion of the axial length of the ion guide or ion trap. Preferably, the first means is arranged and adapted to maintain one or more substantially quadratic potential wells along at least 1%, 5%, 10%, 20%, 30%, 40%, 50%, 60%, 70%, 80%, 90%, 95% or 100% of the axial length of the ion guide or ion trap.

The first means is preferably arranged and adapted to maintain one or more substantially quadratic potential wells having a depth selected from the group consisting of: (i) <10 V; (ii) 10-20 V; (iii) 20-30 V; (iv) 30-40 V; (v) 40-50 V; (vi) 50-60 V; (vii) 60-70 V; (viii) 70-80 V; (ix) 80-90 V; (x) 90-100 V; and (xi) >100 V. According to a preferred embodiment the first means is arranged and adapted to maintain one or more substantially quadratic potential wells having a minimum located at a first position at a first time along the axial length of the ion guide or ion trap. Preferably, the ion guide or ion trap has an ion entrance and an ion exit, and wherein the first position is located at a distance L downstream of the ion entrance and/or at a distance L upstream of the ion exit, and wherein L is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The first means preferably comprises one or more DC voltage supplies for supplying one or more DC voltages to at least 1%, 5%, 10%, 20%, 30%, 40%, 50%, 60%, 70%, 80%, 90%, 95% or 100% of the electrodes. Preferably, the first means is arranged and adapted to provide one or more substantially quadratic potential wells wherein the axial potential increases substantially as the square of the distance or displacement away from the minimum or centre of the potential well.

According to a preferred embodiment the modulation means is arranged and adapted to modulate or oscillate the position of the one or more substantially quadratic potential wells and/or the minimum of the one or more substantially quadratic potential wells along at least 1%, 5%, 10%, 20%, 30%, 40%, 50%, 60%, 70%, 80%, 90%, 95% or 100% of axial length of the ion guide or ion trap.

The modulation means preferably comprises one or more DC voltage supplies for supplying one or more DC voltages to at least 1%, 5%, 10%, 20%, 30%, 40%, 50%, 60%, 70%, 80%, 90%, 95% or 100% of the electrodes.

According to a preferred embodiment the modulation means is arranged and adapted to modulate or oscillate the position of the one or more quadratic potential wells and/or the minimum of the one or more quadratic potential wells in a substantially periodic and/or regular manner. Preferably, the modulation means is arranged and adapted to modulate or oscillate the position of the one or more substantially quadratic potential wells and/or the minimum of the one or more substantially quadratic potential wells with or at a first frequency $f_1$, wherein $f_1$ is selected from the group consisting of: (i) <5 kHz; (ii) 5-10 kHz; (iii) 10-15 kHz; (iv) 15-20 kHz; (v) 20-25 kHz; (vi) 25-30 kHz; (vii) 30-35 kHz; (viii) 35-40 kHz; (ix) 40-45 kHz; (x) 45-50 kHz; (xi) 50-55 kHz; (xii) 55-60 kHz; (xiii) 60-65 kHz; (xiv) 65-70 kHz; (xv) 70-75 kHz; (xvi) 75-80 kHz; (xvii) 80-85 kHz; (xviii) 85-90 kHz; (xix) 90-95 kHz; (xx) 95-100 kHz; and (xxi) >100 kHz.

According to a preferred embodiment the modulation means is arranged and adapted to modulate or oscillate the position of the one or more substantially quadratic potential wells and/or the minimum of the one or more substantially quadratic potential wells with or at a first frequency $f_1$, wherein the first frequency $f_1$ is greater than the resonance or fundamental harmonic frequency of at least 5%, 10%, 15%, 20%, 25%, 30%, 35%, 40%, 45%, 50%, 55%, 60%, 65%, 70%, 75%, 80%, 85%, 90%, 95% or 100% of the ions located within an ion trapping region within the ion guide or ion trap. Preferably, the first frequency $f_1$ is at least 5%, 10%, 15%, 20%, 25%, 30%, 35%, 40%, 45%, 50%, 55%, 60%, 65%, 70%, 75%, 80%, 85%, 90%, 95%, 100%, 110%, 120%, 130%, 140%, 150%, 160%, 170%, 180%, 190%, 200%, 250%, 300%, 350%, 400%, 450%, 500% greater than the resonance or fundamental harmonic frequency of at least 5%, 10%, 15%, 20%, 25%, 30%, 35%, 40%, 45%, 50%, 55%, 60%, 65%, 70%, 75%, 80%, 85%, 90%, 95% or 100% of the ions located within an ion trapping region within the ion guide or ion trap.

The modulation means is preferably arranged and adapted to modulate or oscillate the position of the one or more quadratic potential wells and/or the minimum of the one or more quadratic potential wells at either a substantially constant frequency or a substantially non-constant frequency.

According to a preferred embodiment the ejection means is arranged and adapted to alter and/or vary and/or scan the amplitude of the modulation or oscillation of the position of the one or more quadratic potential wells and/or the position of the minimum of the one or more quadratic potential wells.

The ejection means is preferably arranged and adapted to increase the amplitude of the modulation or oscillation of the position of the one or more quadratic potential wells and/or the position of the minimum of the one or more quadratic potential wells. Preferably, the ejection means is arranged and adapted to increase the amplitude of the modulation or oscillation of the position of the one or more quadratic potential wells and/or the position of the minimum of the one or more quadratic potential wells substantially linearly with time.

According to a preferred embodiment the ejection means is arranged and adapted to alter and/or vary and/or scan the frequency of modulation or oscillation of the position of the one or more quadratic potential wells and/or the position of the minimum of the one or more quadratic potential wells. Preferably, the ejection means is arranged and adapted to decrease the frequency of modulation or oscillation of the position of the one or more quadratic potential wells and/or the position of the minimum of the one or more quadratic potential wells. Preferably, the ejection means is arranged and adapted to decrease the frequency of modulation or oscillation of the position of the one or more quadratic potential wells and/or the position of the minimum of the one or more quadratic potential wells substantially linearly with time.

The ejection means is preferably arranged and adapted to mass selectively eject ions from the ion guide or ion trap. Preferably, the ejection means is arranged and adapted in the first mode of operation to cause substantially all ions having a mass to charge ratio below a first mass to charge ratio cut-off to be ejected from an ion trapping region of the ion guide or ion trap.

The ejection means is preferably arranged and adapted in the first mode of operation to cause substantially all ions having a mass to charge ratio above a first mass to charge ratio cut-off to remain or be retained or confined within an ion trapping region of the ion guide or ion trap.

The first mass to charge ratio cut-off preferably falls within a range selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-1100; (xii) 1100-1200; (xiii) 1200-1300; (xiv) 1300-1400; (xv) 1400-1500; (xvi) 1500-1600; (xvii) 1600-1700; (xviii) 1700-1800; (xix) 1800-1900; (xx) 1900-2000; and (xxi) >2000.

According to a preferred embodiment the ejection means is arranged and adapted to increase the first mass to charge ratio cut-off. Preferably, the ejection means is arranged and adapted to increase the first mass to charge ratio cut-off in a substantially continuous and/or linear and/or progressive and/or regular manner. According to a less preferred embodiment the ejection means is arranged and adapted to increase the first mass to charge ratio cut-off in a substantially non-continuous and/or non-linear and/or non-progressive and/or irregular manner.

According to a preferred embodiment the ejection means is arranged and adapted in the first mode of operation to eject ions substantially axially from the ion guide or ion trap.

According to a preferred embodiment ions are arranged to be trapped or axially confined within an ion trapping region within the ion guide or ion trap, the ion trapping region having a length l, wherein l is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

According to a preferred embodiment the ion trap or ion guide comprises a linear ion trap or ion guide. Preferably, the ion guide or ion trap comprises a multipole rod set ion guide or ion trap such as a quadrupole, hexapole, octapole or higher order multipole rod set.

The plurality of electrodes preferably have a cross-section selected from the group consisting of: (i) approximately or substantially circular; (ii) approximately or substantially hyperbolic; (iii) approximately or substantially arcuate or part-circular; and (iv) approximately or substantially rectangular or square. Preferably, a radius inscribed by the multipole rod set ion guide or ion trap is selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to a preferred embodiment the ion guide or ion trap is segmented axially or comprises a plurality of axial segments. Preferably, the ion guide or ion trap comprises x axial segments, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-100; and (xi) >100. According to a preferred embodiment each axial segment comprises 1, 2, 3, 4, 5, 6, 7, 8, 9, 10, 11, 12, 13, 14, 15, 16, 17, 18, 19, 20 or >20 electrodes. Preferably, the axial length of at least 1%, 5%, 10%, 20%, 30%, 40%, 50%, 60%, 70%, 80%, 90%, 95% or 100% of the axial segments is selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The spacing between at least 1%, 5%, 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to an alternative embodiment the ion guide or ion trap may comprise a plurality of non-conducting, insulating or ceramic rods, projections or devices. Preferably, the ion guide or ion trap comprises 1, 2, 3, 4, 5, 6, 7, 8, 9, 10, 11, 12, 13, 14, 15, 16, 17, 18, 19, 20 or >20 rods, projections or devices. Preferably, the plurality of non-conducting, insulating or ceramic rods, projections or devices further comprise one or more resistive or conducting coatings, layers, electrodes, films or surfaces disposed on, around, adjacent, over or in close proximity to the rods, projections of devices.

According to another embodiment the ion guide or ion trap comprises a plurality of electrodes having apertures wherein ions are transmitted, in use, through the apertures. Preferably, at least 1%, 5%, 10%, 20%, 30%, 40%, 50%, 60%, 70%, 80%, 90%, 95% or 100% of the electrodes have apertures which are substantially the same size or which have substantially the same area. Alternatively, at least 1%, 5%, 10%, 20%, 30%, 40%, 50%, 60%, 70%, 80%, 90%, 95% or 100% of the electrodes have apertures which become progressively larger and/or smaller in size or in area in a direction along the axis of the ion guide or ion trap. Preferably, at least 1%, 5%, 10%, 20%, 30%, 40%, 50%, 60%, 70%, 80%, 90%, 95% or 100% of the electrodes have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

According to another embodiment the ion guide or ion trap comprises a plurality of plate or mesh electrodes and wherein at least some of the electrodes are arranged generally in the plane in which ions travel in use. Preferably, the ion guide or ion trap comprises a plurality of plate or mesh electrodes and wherein at least 50%, 55%, 60%, 65%, 70%, 75%, 80%, 85%, 90%, 95% or 100% of the electrodes are arranged generally in the plane in which ions travel in use. The ion guide or ion trap may according to this embodiment comprise at least 2, 3, 4, 5, 6, 7, 8, 9, 10, 11, 12, 13, 14, 15, 16, 17, 18, 19, 20 or >20 plate or mesh electrodes. Preferably, the plate or mesh electrodes have a thickness selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm.

The plate or mesh electrodes may be spaced apart from one another by a distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm. The plate or mesh electrodes are preferably supplied with an AC or RF voltage. Adjacent plate or mesh electrodes are preferably supplied with opposite phases of the AC or RF voltage. Preferably, the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz. Preferably, the amplitude of the AC or RF voltage is selected from the group consisting of: (i) <50V peak to peak; (ii) 50-100V peak to peak; (iii) 100-150V peak to peak; (iv) 150-200V peak to peak; (v) 200-250V peak to peak; (vi) 250-300V peak to peak; (vii) 300-350V peak to peak; (viii) 350-400V peak to peak; (ix) 400-450V peak to peak; (x) 450-500V peak to peak; and (xi) >500V peak to peak.

The ion guide or ion trap preferably further comprises a first outer plate electrode arranged on a first side of the ion guide or ion trap and a second outer plate electrode arranged on a second side of the ion guide or ion trap. A biasing means is preferably provided to bias the first outer plate electrode and/or the second outer plate electrode at a bias DC voltage with respect to the mean voltage of the plate or mesh electrodes to which an AC or RF voltage is applied. The biasing means may be arranged and adapted to bias the first outer plate electrode and/or the second outer plate electrode at a voltage selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

According to an embodiment the first outer plate electrode and/or the second outer plate electrode are supplied in use with a DC only voltage. According to an alternative embodiment the first outer plate electrode and/or the second outer plate electrode are supplied in use with an AC or RF only voltage. According to a further embodiment the first outer plate electrode and/or the second outer plate electrode are supplied in use with a DC and an AC or RF voltage.

One or more insulator layers are preferably interspersed, arranged, interleaved or deposited between the plurality of plate or mesh electrodes. The ion guide or ion trap may comprise a substantially curved or non-linear ion guiding or ion trapping region. The ion guide or ion trap may comprise a plurality of axial segments. Preferably, the ion guide or ion trap comprises at least 5, 10, 15, 20, 25, 30, 35, 40, 45, 50, 55, 60, 65, 70, 75, 80, 85, 90, 95 or 100 axial segments.

The ion guide or ion trap may have a substantially circular, oval, square, rectangular, regular or irregular cross-section. The ion guide or ion trap may have an ion guiding region which varies in size and/or shape and/or width and/or height and/or length along the ion guiding region.

According to a preferred embodiment the ion guide or ion trap comprises 1, 2, 3, 4, 5, 6, 7, 8, 9, 10 or >10 electrodes. The ion guide or ion trap may comprise at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes. The ion guide or ion trap preferably has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The ion guide or ion trap preferably further comprises means arranged and adapted to maintain in a mode of operation the ion guide or ion trap at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; (xi) $<1.0\times10^{-11}$ mbar; and (xii) $<1.0\times10^{-12}$ mbar.

According to an embodiment the ion guide or ion trap further comprises means arranged and adapted to maintain in a mode of operation the ion guide or ion trap at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$-$10^{-2}$ mbar; and (x) $10^{-4}$-$10^{-1}$ mbar.

In a mode of operation ions are trapped but are not substantially fragmented within the ion guide or ion trap. The ion guide or ion trap may further comprise means arranged and adapted to collisionally cool or substantially thermalise ions within the ion guide or ion trap in a mode of operation. The means arranged and adapted to collisionally cool or thermalise ions within the ion guide or ion trap is preferably arranged to collisionally cool or to substantially thermalise ions prior to and/or subsequent to ions being ejected from the ion guide or ion trap.

According to a preferred embodiment the ion guide or ion trap may further comprise fragmentation means arranged and adapted to substantially fragment ions within the ion guide or ion trap. The fragmentation means is preferably arranged and adapted to fragment ions by Collisional Induced Dissociation ("CID"). Alternatively, the fragmentation means is arranged and adapted to fragment ions by Surface Induced Dissociation ("SID").

The ion guide or ion trap is preferably arranged and adapted in a second mode of operation to resonantly and/or mass selectively eject ions from the ion guide or ion trap. Preferably, the ion guide or ion trap is arranged and adapted in the second mode of operation to eject ions axially and/or radially from the ion guide or ion trap. According to an embodiment the ion guide or ion trap is arranged and adapted in the second mode of operation to adjust the frequency and/or amplitude of an AC or RF voltage applied to the electrodes in order to eject ions by mass selective instability.

Preferably, the ion guide or ion trap is arranged and adapted in the second mode of operation to superimpose an AC or RF supplementary waveform or voltage to the plurality of electrodes in order to eject ions by resonance ejection. Preferably, the ion guide or ion trap is arranged and adapted in the second mode of operation to apply a DC bias voltage to the plurality of electrodes in order to eject ions.

According to a preferred embodiment in a further mode of operation the ion guide or ion trap is arranged to transmit ions or store ions without the ions being mass selectively and/or non-resonantly ejected from the ion guide or ion trap. In a further mode of operation the ion guide or ion trap is preferably arranged to mass filter or mass analyse ions.

According to a preferred embodiment in a further mode of operation the ion guide or ion trap is arranged to act as a collision or fragmentation cell without ions being mass selectively and/or non-resonantly ejected from the ion guide or ion trap.

According to a preferred embodiment the ion guide or ion trap further comprises means arranged and adapted to store or trap ions within the ion guide or ion trap in a mode of operation at one or more positions which are closest to the entrance and/or centre and/or exit of the ion guide or ion trap. According to a preferred embodiment the ion guide or ion trap further comprises means arranged and adapted to trap ions within the ion guide or ion trap in a mode of operation and to progressively move the ions towards the entrance and/or centre and/or exit of the ion guide or ion trap.

The ion guide or ion trap preferably further comprises means arranged and adapted to apply one or more transient DC voltages or one or more transient DC voltage waveforms to the electrodes initially at a first axial position, wherein the one or more transient DC voltages or one or more transient DC voltage waveforms are then subsequently provided at second, then third different axial positions along the ion guide or ion trap.

The ion guide or ion trap preferably further comprises means arranged and adapted to apply, move or translate one or more transient DC voltages or one or more transient DC voltage waveforms from one end of the ion guide or ion trap to another end of the ion guide or ion trap in order to urge ions along at least a portion of the axial length of the ion guide or ion trap.

Preferably, the one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells. The one or more transient DC voltage waveforms may comprise a repeating waveform or square wave.

The ion guide or ion trap may further comprise means arranged to apply one or more trapping electrostatic or DC potentials at a first end and/or a second end of the ion guide or ion trap.

The ion guide or ion trap may further comprise means arranged to apply one or more trapping electrostatic potentials along the axial length of the ion guide or ion trap.

According to another aspect of the present invention there is provided a mass spectrometer comprising an ion guide or an ion trap as detailed above.

The mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; and (xvii) an Atmospheric Pressure Matrix Assisted Laser Desorption Ionisation ion source; and (xviii) a Thermospray ion source. The mass spectrometer preferably comprises a continuous or pulsed ion source.

The mass spectrometer may further comprise one or more further ion guides or ion traps arranged upstream and/or downstream of the ion guide or ion trap. The one or more further ion guides or ion traps may be arranged and adapted to collisionally cool or to substantially thermalise ions within the one or more further ion guides or ion traps. Preferably, the one or more further ion guides or ion traps are arranged and adapted to collisionally cool or to substantially thermalise ions within the one or more further ion guides or ion traps prior to and/or subsequent to ions being introduced into the ion guide or ion trap.

According to an embodiment the mass spectrometer further comprises means arranged and adapted to introduce, axially inject or eject, radially inject or eject, transmit or pulse ions from the one or more further ion guides or ion traps into the ion guide or ion trap. Preferably, the mass spectrometer further comprises means arranged and adapted to introduce, axially inject or eject, radially inject or eject, transmit or pulse ions into the ion guide or ion trap.

The mass spectrometer preferably comprises means arranged and adapted to substantially fragment ions within the one or more further ion guides or ion traps.

One or more ion detectors are preferably arranged upstream and/or downstream of the preferred ion guide or ion trap.

The mass spectrometer preferably further comprises a mass analyser arranged downstream and/or upstream of the ion guide or ion trap. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Fourier Transform mass spectrometer; and (xiii) a quadrupole mass analyser.

According to another aspect of the present invention there is provided a method of guiding or trapping ions comprising:

providing an ion trap or ion guide comprising a plurality of electrodes;

applying an AC or RF voltage to at least some of the plurality of electrodes in order to confine radially at least some ions within the ion guide or ion trap;

maintaining one or more substantially quadratic potential wells along at least a portion of the axial length of the ion guide or ion trap in a first mode of operation, the one or more substantially quadratic potential wells having a minimum;

modulating or oscillating the position of the one or more substantially quadratic potential wells and/or the position of the minimum of the one or more substantially quadratic potential wells along at least a portion of the axial length of the ion guide or ion trap; and ejecting at least some ions from a trapping region of the ion guide or ion trap in a substantially non-resonant manner whilst other ions are arranged to remain substantially trapped within the trapping region of the ion guide or ion trap.

According to another aspect of the present invention there is provided a method of mass spectrometry comprising the method as disclosed above.

According to another aspect of the present invention there is provided an ion guide or ion trap comprising:

a plurality of electrodes;

first means arranged and adapted to maintain one or more substantially quadratic potential wells along at least a portion of the axial length of the ion guide or ion trap in a first mode of operation, the one or more substantially quadratic potential wells having a minimum; and modulation means arranged and adapted to modulate or oscillate the position of the one or more substantially quadratic potential wells and/or the position of the minimum of the one or more substantially quadratic potential wells along at least a portion of the axial length of the ion guide or ion rap.

According to another aspect of the present invention there is provided a method of guiding or trapping ions comprising:

providing an ion trap or ion guide comprising a plurality of electrodes;

maintaining one or more substantially quadratic potential wells along at least a portion of the axial length of the ion guide or ion trap in a first mode of operation, the one or more substantially quadratic potential wells having a minimum; and modulating or oscillating the position of the one or more substantially quadratic potential wells and/or the position of the minimum of the one or more substantially quadratic potential wells along at least a portion of the axial length of the ion guide or ion trap.

According to another aspect of the present invention there is provided a linear ion guide or ion trap comprising means arranged and adapted to mass selectively eject ions from the ion guide or ion trap in a substantially non-resonant manner whilst other ions remain trapped within the ion guide or ion trap.

According to an aspect of the present invention there is provided a method of guiding or trapping ions comprising mass selectively ejecting ions from an ion guide or ion trap in a substantially non-resonant manner whilst trapping other ions within said ion guide or ion trap.

The preferred embodiment relates to a linear ion guide or ion trap wherein an AC or RF voltage is applied to the electrodes forming the ion guide or ion trap in order to radially confine ions about the axis of the ion guide or ion trap.

A quadratic axial potential well is preferably superimposed about a reference point within an axial ion trapping region of the preferred ion guide or ion trap. The quadratic potential well preferably exerts a force on ions displaced axially from the reference point so as to accelerate the ions back towards the reference point.

The relative position of the axial potential well is preferably varied or modulated with time so as to effectively cause ions to oscillate about the reference point. The position of the potential well is preferably varied with time such that the trapped ions preferably oscillate about the reference point at non-resonant frequencies i.e. at frequencies other than the fundamental or first harmonic frequency of the ions. Ions having different mass to charge ratios will oscillate along the axis of the preferred ion guide or ion trap with different characteristic amplitudes. This enables ions to be ejected from the preferred ion guide or ion trap in a non-resonant manner.

Ions can be ejected from the preferred ion guide or ion trap by modulating the potential well so as to vary the maximum amplitude of the axial oscillations of the ions. This can be arranged so as to cause ions having a relatively low mass to charge ratio to oscillate axially with a sufficiently large amplitude such that these ions will then escape from the axial potential well. These ions will thus become axially ejected from the preferred ion guide or ion trap. The ions are therefore preferably mass-selectively ejected from the preferred ion guide or ion trap in the axial direction and in a substantially non-resonant manner i.e. ions are not being ejected from the preferred ion guide or ion trap by exciting them with a voltage having a frequency which corresponds with the inherent fundamental resonance frequency of the ions.

The potential well maintained along the trapping region of the preferred ion guide or ion trap is quadratic. The position of the potential well is varied with time so that the quadratic potential well is preferably effectively being continually passed through and along the axial ion trapping region from one side of the ion guide or ion trap to the other. The axial potential well can therefore be considered to be modulated in a manner such that the minimum of the quadratic axial potential well oscillates axially about the reference point.

The location of the minimum of the applied axial DC or electrostatic quadratic potential is preferably varied in a substantially periodic fashion so as to cause ions having differing mass to charge ratios to oscillate at non-resonant frequencies along the axis of the preferred ion guide or ion trap with different characteristic amplitudes. Mass selective non-resonant axial ejection of ions is then preferably achieved by, for example, altering the frequency of the periodic modulation of the axial quadratic DC potential well. Alternatively, the amplitude of the oscillation of the axial quadratic potential minimum may be varied. This can preferably increase the characteristic amplitude of axial oscillations of the ions. In this manner the amplitude of axial oscillation of ions can be varied such that ions having a desired mass to charge ratio are preferably caused to leave the axial ion trapping region and hence are preferably axially ejected from the preferred ion guide or ion trap. Ions may be sequentially ejected from the preferred ion guide or ion trap and may be detected by an ion detector. This enables a mass spectrum to be produced.

According to the preferred embodiment a linear axial superimposed DC electric field is preferably maintained along at least a portion of the length of the preferred ion guide or ion trap. The position of the minimum of an axial potential well is then modulated preferably in a substantially symmetrical manner in the axial direction about a mean position which is preferably the centre of the preferred ion guide or ion trap. Ions therefore preferably acquire an axial motion related to the frequency of this modulation and the frequency of their motion within the axial potential well.

According to the preferred embodiment the axial quadratic potential well is preferably modulated at a substantially higher frequency than the characteristic fundamental resonance or first harmonic frequency of ions trapped within the axial quadratic potential well. Accordingly, ions can be considered to be non-resonantly ejected rather than resonantly ejected from the preferred ion guide or ion trap.

The preferred ion guide or ion trap may comprise a multipole rod set. A segmented quadrupole rod set is particularly preferred. In the preferred embodiment ions are preferably introduced axially into the preferred ion guide or ion trap.

The preferred ion guide or ion trap is particularly advantageous compared to other known ion traps. Modulation of the axial quadratic potential well is not required in order to trap ions but instead is only used in order to axially eject ions from the preferred ion guide or ion trap in a non-resonant manner. Ions are preferably introduced into the preferred ion guide or ion trap orthogonally to the AC or RF voltage applied to the electrodes of the ion guide or ion trap and which acts to confine ions radially within the ion guide or ion trap. This is in contrast to conventional 3D or Paul ion traps. It is therefore considerably easier to inject ions into the preferred ion guide or ion trap than into a conventional 3D or Paul ion trap.

According to a preferred embodiment ions are trapped both axially and radially within the preferred ion guide or ion trap. The ions may then be cooled to thermal energies within the preferred ion guide or ion trap by the introduction of collision gas into the preferred ion guide or ion trap. Ions may therefore be thermalised within the preferred ion guide or ion trap prior to mass-selective axial non-resonant ion ejection according to the preferred embodiment.

The preferred ion guide or ion trap preferably has substantially no physical restriction on the size of the device in the axial direction. This allows a much larger potential ion trapping capacity to be achieved compared to, for example, conventional 3D or Paul ion traps.

According to other embodiments a higher order multipole rod set or an ion tunnel or ion funnel ion guide or ion trap may be used.

The preferred ion guide or ion trap has the advantage that in an alternative mode of operation the quadratic axial DC potential may be removed thereby enabling the preferred ion guide or ion trap to be used as a conventional ion guide, ion trap, mass filter or mass analyser in the alternative mode of operation.

Various embodiments of the present invention will now be described, by way of example only, and with reference to the accompanying drawings in which.

Figure 8A:
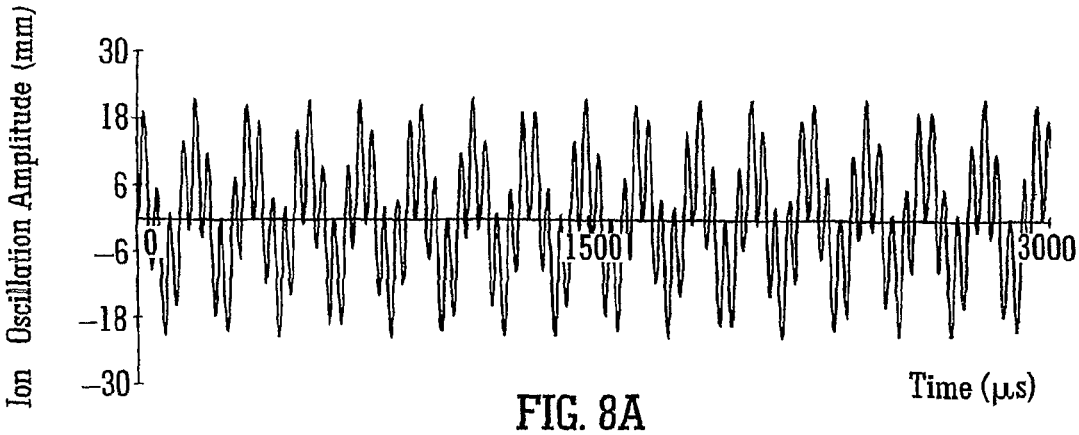
Figure 8B:
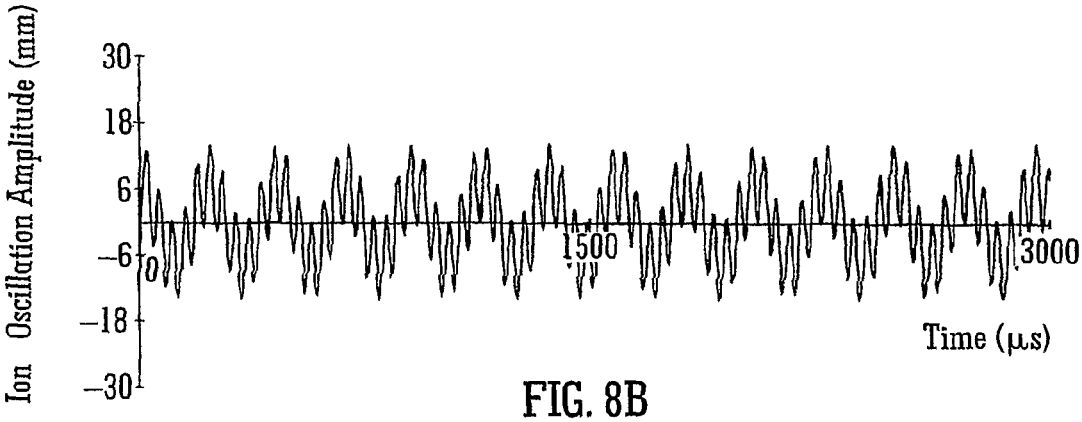
Figure 8C:
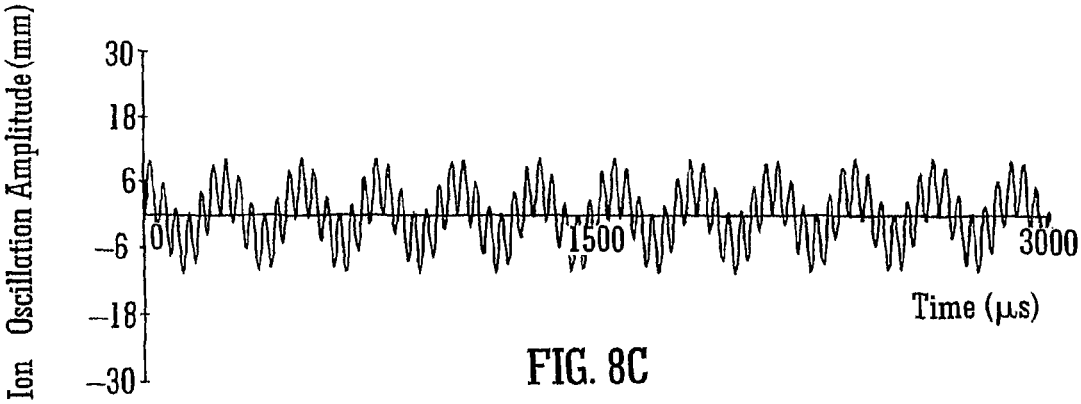
Figure 9A:
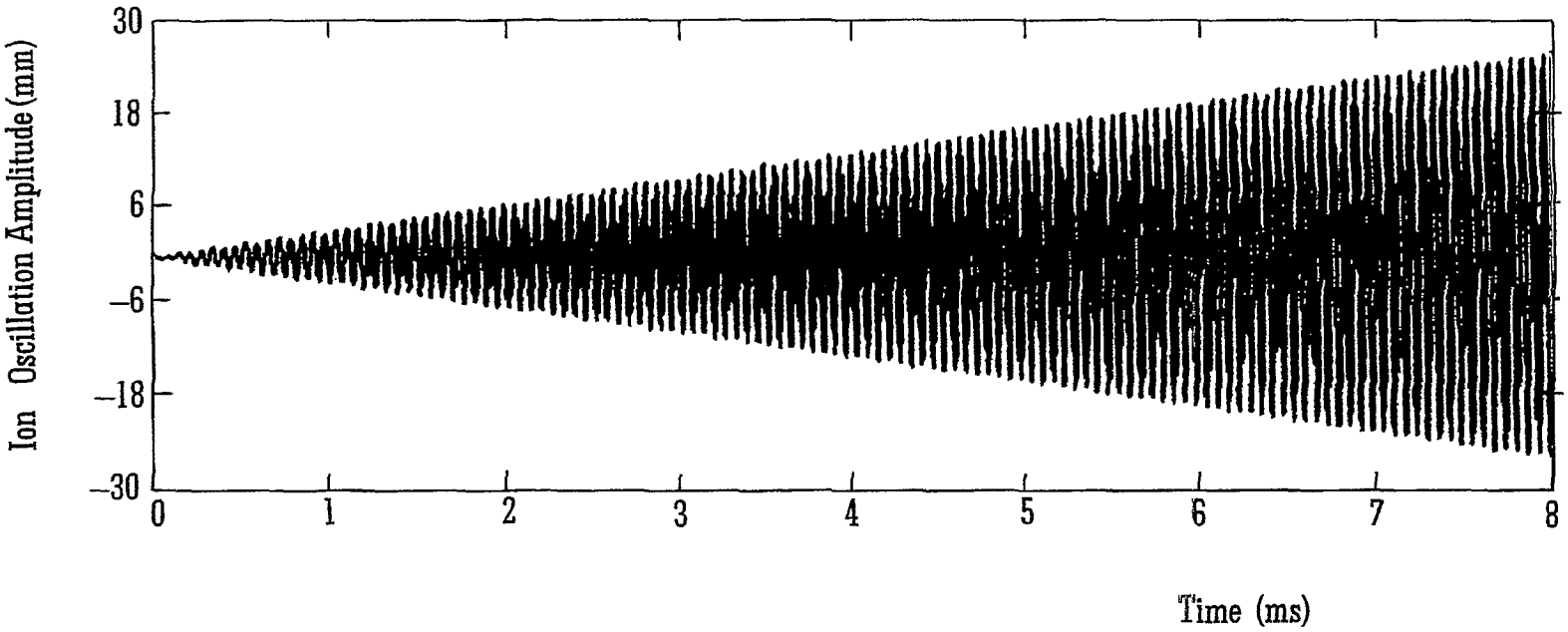
Figure 9B:
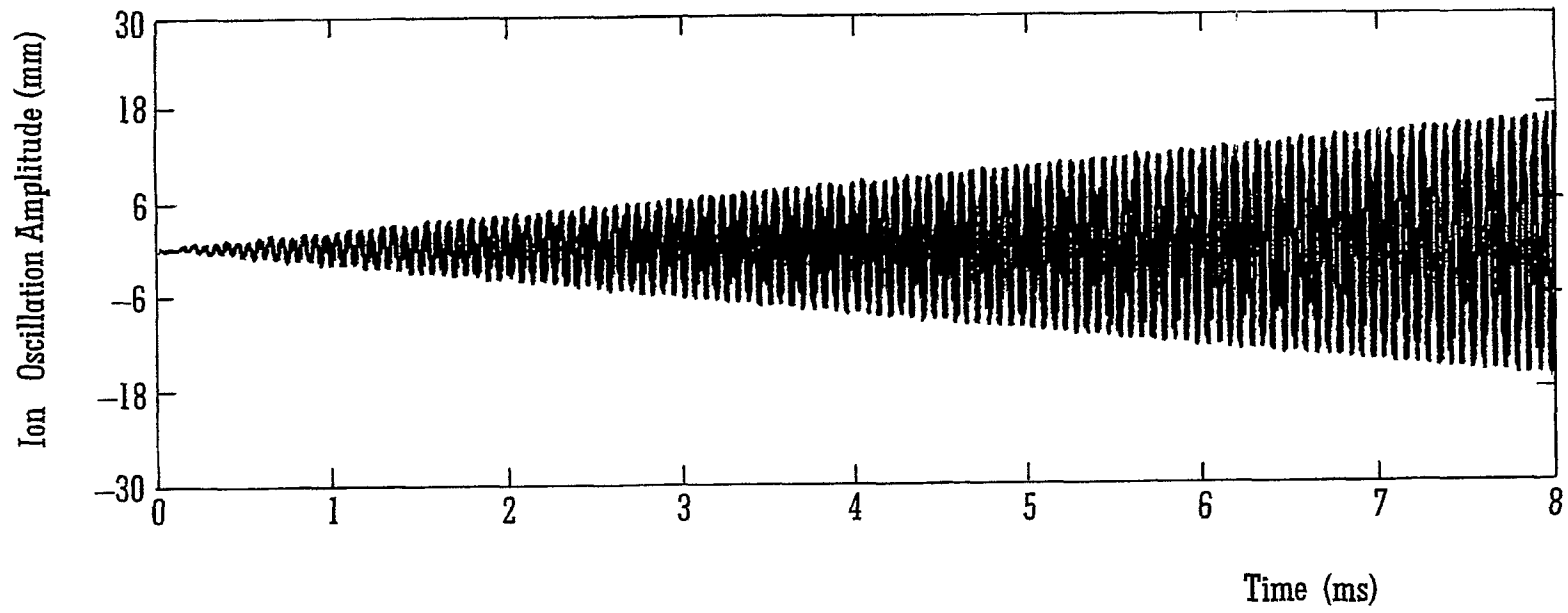
Figure 9C:
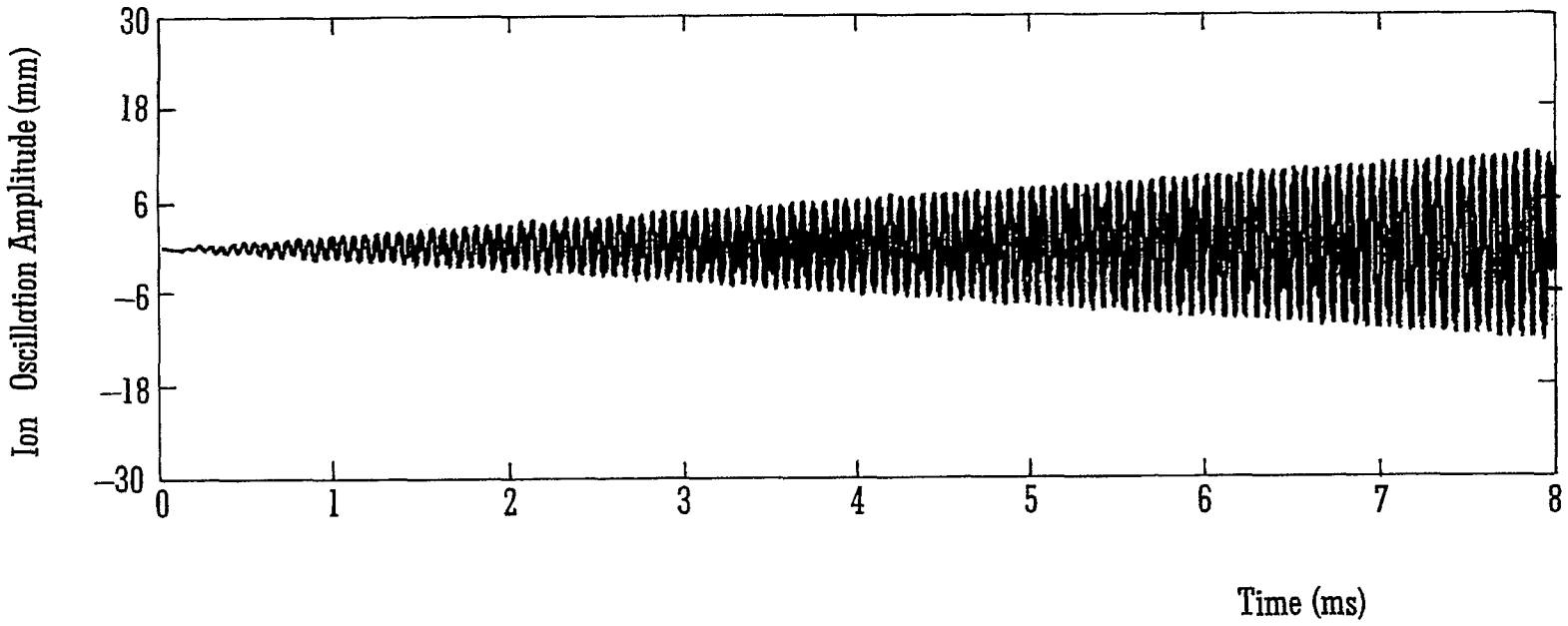
Figure 10:
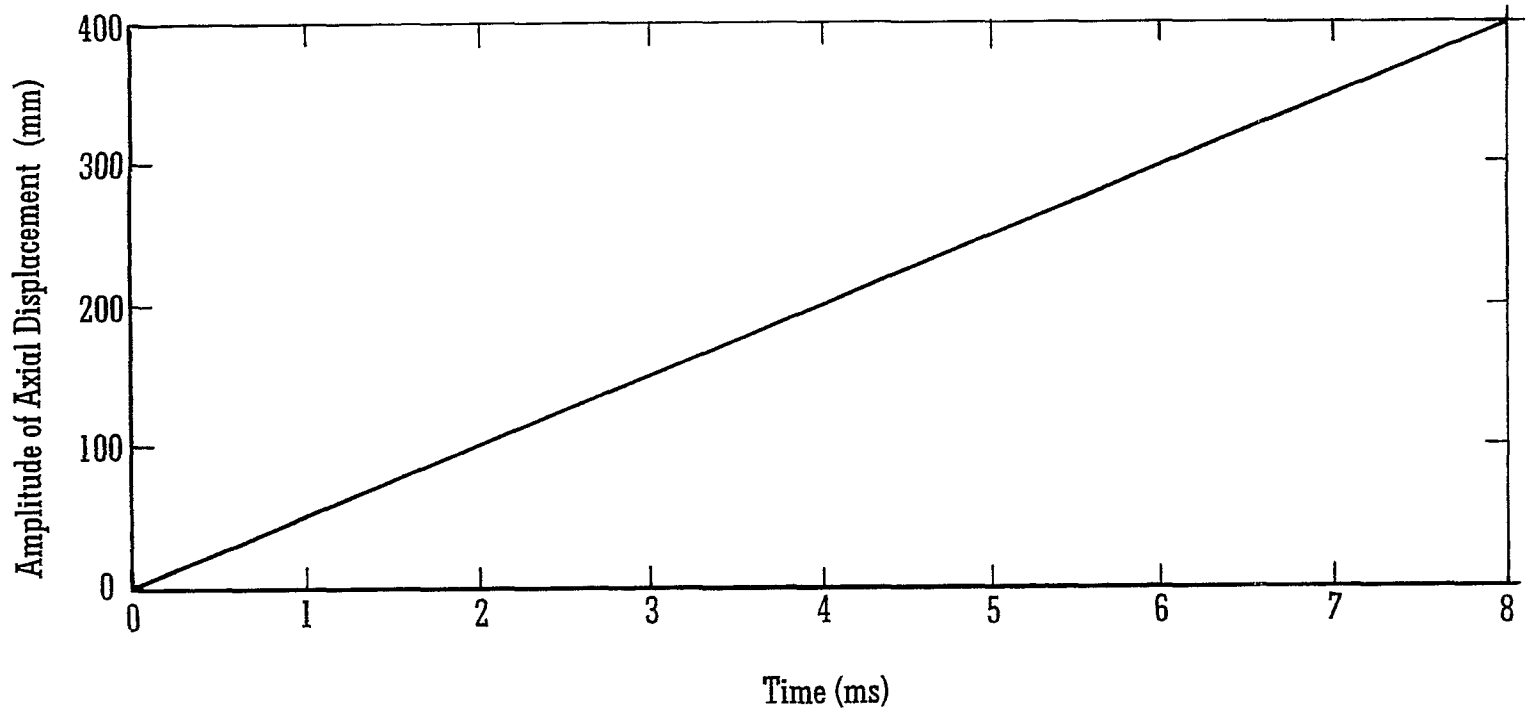
Figure 11:
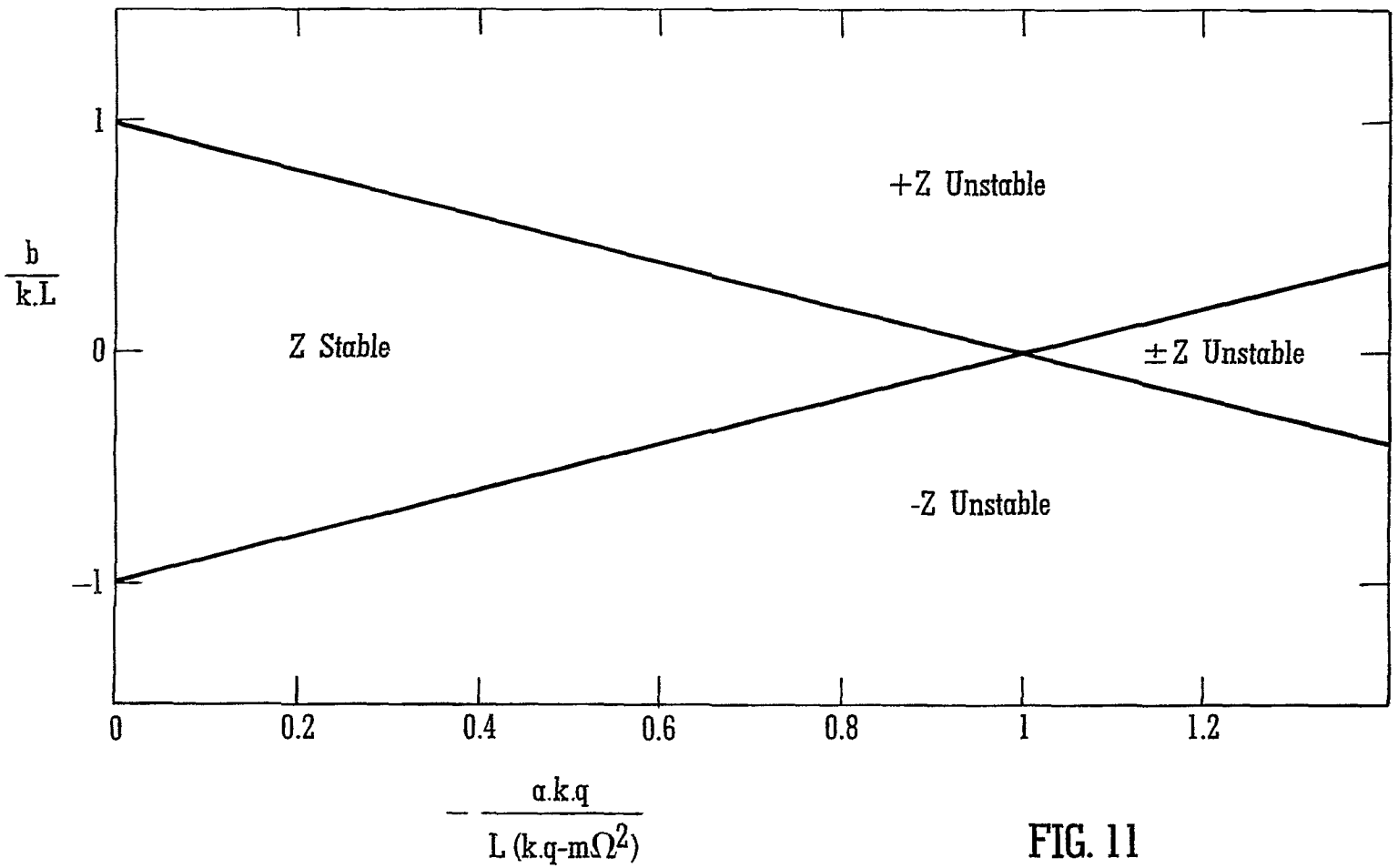

FIG. 8A shows the amplitude of ion oscillation for ions having a mass to charge ratio of 200 along the axis of a preferred ion guide or ion trap, FIG. 8B shows the amplitude of ion oscillation for ions having a mass to charge ratio of 300 along the axis of a preferred ion guide or ion trap and FIG. 8C shows the amplitude of ion oscillation for ions having a mass to charge ratio of 400 along the axis of a preferred ion guide or ion trap;

FIG. 9A shows a plot of the calculated amplitude of ion motion along the axis of a preferred ion guide or ion trap versus time for ions having a mass to charge ratio of 200 when scanning the amplitude of displacement of the minimum of an axial quadratic potential well at a fixed modulation frequency, FIG. 9B shows a plot of the calculated amplitude of ion motion along the axis of a preferred ion guide or ion trap versus time for ions having a mass to charge ratio of 300 when scanning the amplitude of displacement of the minimum of an axial quadratic potential well at a fixed modulation frequency and FIG. 9C shows a plot of the calculated amplitude of ion motion along the axis of a preferred ion guide or ion trap versus time for ions having a mass to charge ratio of 400 when scanning the amplitude of displacement of the minimum of an axial quadratic potential well at a fixed modulation frequency;

FIG. 10 shows how the amplitude of axial displacement of the minimum of an axial quadratic potential well may be scanned as a function of time according to an embodiment; and FIG. 11 shows a simplified normalised stability diagram for an ion guide or ion trap according to a preferred embodiment.

Figure 1:
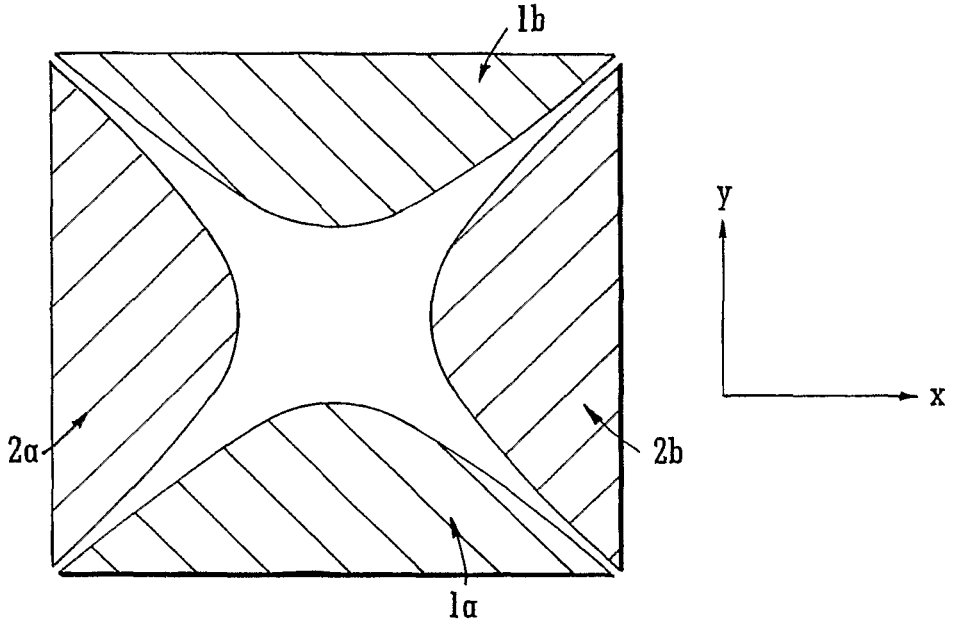
FIG. 1 shows a cross sectional view of a preferred segmented rod set ion guide or ion trap according to an embodiment.
Figure 2:
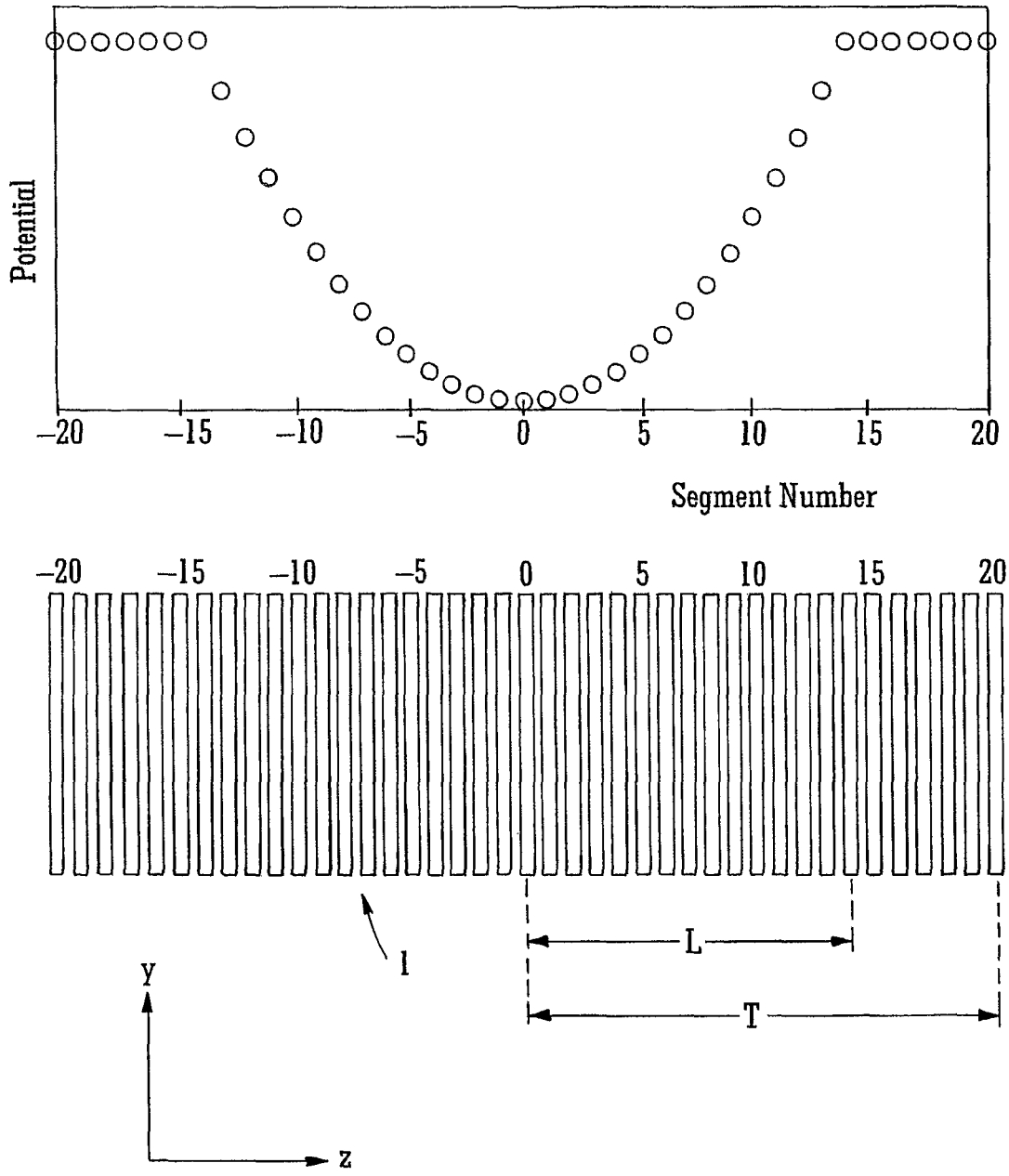
FIG. 2 shows a side view of a preferred segmented ion guide or ion trap together with a plot showing a quadratic DC or electrostatic potential being maintained along a portion of the length of the preferred ion guide or trap according to a preferred embodiment.

Various embodiments of the present invention will now be described. According to a preferred embodiment the preferred ion guide or ion trap preferably comprises a segmented quadrupole rod set having hyperbolic shaped electrodes arranged as shown in FIG. 1. Each rod forming part of the overall quadrupole rod set assembly is preferably divided into a plurality of axial segments as shown in FIG. 2. The preferred ion guide or ion trap preferably comprises a sufficient number of axial segments so as to allow DC or electrostatic potentials applied to each of the various segments to relax, for example, to a substantially quadratic or near quadratic function.

FIG. 1 shows a cross-sectional view of a preferred ion guide or ion trap which preferably comprises a first pair of hyperbolic shaped electrodes or rods 1*a*,1*b* and a second pair of hyperbolic shaped electrodes or rods 2*a*,2*b*. Each electrode or rod 1*a*,1*b*,2*a*,2*b* is preferably axially segmented as shown in FIG. 2.

In operation an AC or RF voltage is preferably applied to each of the electrodes forming the preferred ion guide or ion trap so as to create a radial pseudo-potential well. The pseudo-potential well acts to confine ions radially (i.e. in the x,y plane) within the preferred ion guide or trap.

The AC or RF voltage applied to the electrodes forming the first pair of rods 1*a*,1*b* is preferably of the form:

$$\phi_1=\phi_o\cos(\Omega_0\cdot t) \tag{1}$$

wherein $\phi_o$ is half of the peak-to-peak voltage of the AC or RF high voltage power supply, t is the time in seconds and $\Omega_0$ is the angular frequency of the AC or RF voltage supply in radians/second.

The AC or RF voltage applied to the electrodes forming the second pair of rods 2*a*,2*b* is preferably of the form:

$$\phi_2=-\phi_o\cos(\Omega_0\cdot t) \tag{2}$$

The potential in the x,y direction is therefore:

$$\phi_{x,y}=\phi_o\cos(\Omega_0\cdot t)\frac{(x^2-y^2)}{2\cdot r_o^2} \tag{3}$$

wherein $r_o$ is the radius of a circle inscribed by the two pairs of rods 1*a*,1*b*;2*a*,2*b*.

Ion motion in the x,y plane may be expressed using Mathieu's equation. The ion motion can be considered as comprising a low amplitude micro-motion with a frequency related to the AC or RF drive frequency superimposed upon a larger secular motion with a frequency related to the mass to charge ratio of the ion. The properties of Mathieu's equation are well known and solutions resulting in stable ion motion may be represented using a stability diagram by plotting the stability boundary conditions for the dimensionless parameters $a_u$ and $q_u$ as will be readily understood by those skilled in the art.

For the embodiment described above the parameters $a_u$ and $q_u$ are:

$$a_u=a_x=-a_y=\frac{8qU_0}{m\Omega_0^2r_0^2} \tag{4}$$

$$q_u=q_x=-q_y=\frac{4q\phi_0}{m\Omega_0^2r_0^2} \tag{5}$$

wherein m is the molecular mass of the ion, $U_0$ is a DC voltage applied to one of the pairs of rods, and q is the electron charge e multiplied by the number of charges on the ions.

The operation of a conventional quadrupole device for mass analysis is well known. The time-averaged effect due to the application of an AC or RF voltage to the electrodes results in the formation of a pseudo-potential well in the radial direction. An approximation of the pseudo-potential well in the x-direction may be given by:

$$V^*_{(x)}=\frac{q\cdot\phi_0^2\cdot x^2}{4\cdot\Omega_0\cdot m\cdot r_0^4} \tag{6}$$

The depth of the potential well for values of $q_x<0.4$ is approximately:

$$\overline{D}_x=\frac{q_x\cdot\phi_0}{8} \tag{7}$$

As the quadrupole is cylindrically symmetrical an identical expression may be derived for the characteristics of the pseudo-potential well in the y-direction.

In addition to the pseudo-potential well which confines ions in the radial direction, an axial quadratic DC potential well or profile is also maintained along at least a portion of the length of the preferred ion guide or ion trap according to the preferred embodiment of the present invention. The quadratic axial potential well is preferably initially provided having a minimum located substantially at the centre or middle of the preferred ion guide or ion trap. The axial DC potential increases as the square of the distance or displacement away from the minimum of the potential well (or the centre or middle of the preferred ion guide or ion trap).

The position of the axial quadratic DC potential well is preferably altered or modulated with time in such a way that the minimum of the axial quadratic DC potential well is preferably caused to oscillate in the axial or z-direction. The axial DC or electrostatic potential profile is therefore preferably modulated in the axial direction as will be described in more detail with reference to FIG. 5. According to an embodiment the minimum of the DC or electrostatic axial potential well oscillates about the centre or middle of the preferred ion guide or ion trap.

A time varying DC or electrostatic potential is therefore preferably maintained along the length of the preferred ion guide or ion trap and is preferably of the form:

$$U_z(t)=\frac{k\cdot[z+a\cdot\cos(\Omega t)]^2}{2} \tag{8}$$

wherein k is the field constant of the axial DC quadratic potential, a is the axial distance along the preferred ion guide or ion trap by which the minimum of the quadratic potential is moved about its mean position and Ω is the frequency of the modulation of the axial quadratic DC potential.

An embodiment corresponding to the ion guide or ion trap shown in FIG. 2 will now be considered in more detail. According to the embodiment shown in FIG. 2 the preferred ion guide or ion trap may comprise 41 axial segments. As shown in FIG. 2, the centremost or middle axial segment may be labelled as segment number 0, and the other segments may be labelled as 1 to 20 and −1 to −20 respectively. The preferred ion guide or ion trap may be considered as having an overall axial length of 2T and an axial ion trapping region within the preferred ion guide or ion trap which has a length 2L.

Reference is also made to the axial quadratic DC potential profile shown in FIG. 2 which is preferably initially maintained along the length of the preferred ion guide or ion trap according to this illustrative embodiment. The DC potential maintained along the preferred ion guide or ion trap increases in proportion to the square of the distance or displacement from the central or middle segment (i.e. segment 0) until segment numbers ±14. Segment numbers ±14 are located at distances ±L from the minimum of the DC potential well (and the centre or middle of the preferred ion guide or ion trap). At distances greater than ±L the DC potentials applied to the various segments of the preferred ion guide or ion trap are preferably constant. Accordingly, ions which escape from the axial quadratic DC potential well or ion trapping region and hence which are displaced at a distance greater than ±L will then experience a substantially field free region wherein the potential remains constant with displacement. These ions in this region will therefore be free to continue to move towards the entrance or exit of the preferred ion guide or ion trap and will then exit the preferred ion guide or ion trap.

The DC potentials applied to segments −15 to −20 and segments 15 to 20 of the preferred ion guide or ion trap preferably remain substantially constant as a function of time whereas the potentials applied to segments −14 to 14 will preferably change as a function of time. The distances ±L therefore define boundaries to an axial ion trapping region within the preferred ion guide or ion trap. Ions which succeed in escaping the confines of the axial quadratic potential well or the axial ion trapping region are preferably no longer axially confined within the preferred ion guide or ion trap and are preferably free to exit the preferred ion guide or ion trap.

Due to field relaxation at the boundaries of the axial ion trapping region at distances ±L, the potential distribution within the axial ion trapping region of the preferred ion guide or ion trap may not be exactly or perfectly quadratic as desired.

Figure 3:
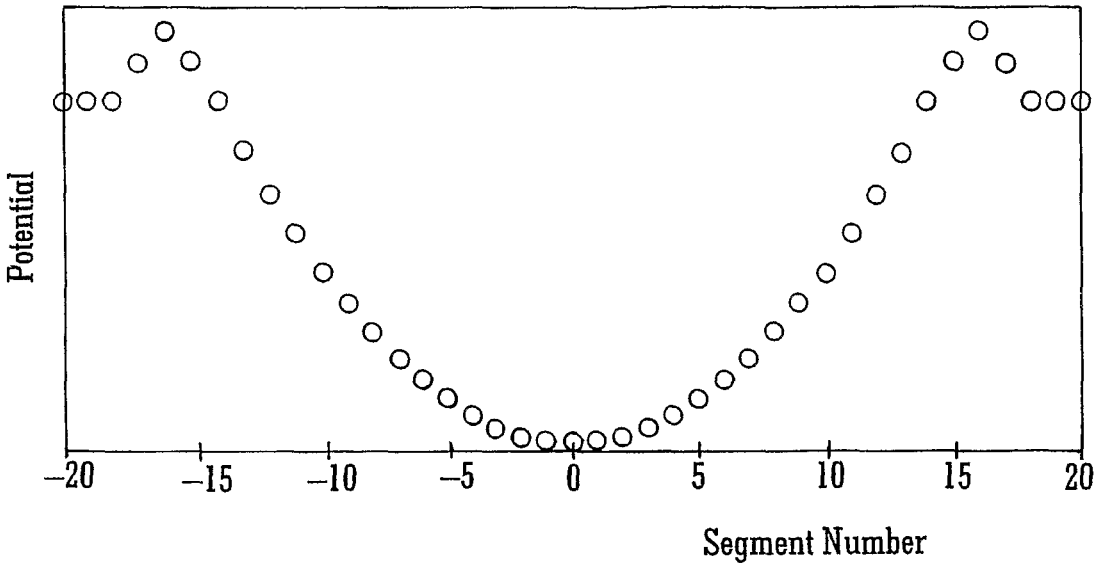
FIG. 3 shows the DC or electrostatic potentials applied to each segment of a preferred segmented ion guide or ion trap according to an embodiment wherein the applied DC or electrostatic potentials are arranged to compensate for field relaxation effects at the boundaries of the axial ion trapping region of the preferred ion guide or ion trap.

In order to address the issue of field relaxation, the DC or electrostatic potentials applied to the electrodes at or around the boundaries of the axial ion trapping region may be modified to correct for distortions. FIG. 3 shows a plot of the DC potentials of each segment of a preferred ion guide or ion trap according to an embodiment which is intended to address the problem of field relaxation at the boundary to the axial ion trapping region. The DC potentials of each segment of the preferred ion guide or ion trap are preferably substantially the same as those shown with reference FIG. 2 except that the potentials of segments ±15 to 17 is preferably higher than the potentials of segments ±18 to 20. The DC potentials of all the segments ±15 to 20 preferably remain substantially constant as a function of time although less preferably it is contemplated that these potentials could vary with time.

The embodiment shown and described above with reference to FIG. 3 is preferably advantageous in that the effect of field relaxation and field penetration at the boundaries of the axial ion trapping region may be substantially alleviated thereby leading to a more accurate, smooth or continuous axial quadratic potential profile being maintained within the axial ion trapping region of the preferred ion guide or ion trap.

Figure 4:
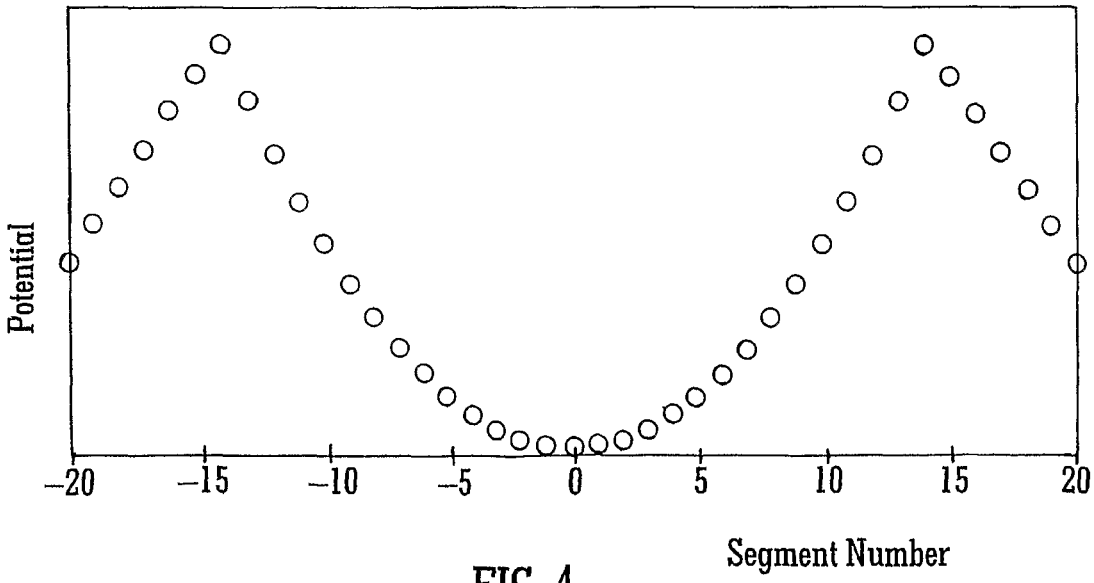
FIG. 4 shows the DC or electrostatic potentials applied to each segment of a preferred segmented ion guide or ion trap according to an embodiment wherein the applied DC or electrostatic potentials are arranged so as to cause ions once they have exited the central axial ion trapping region of the preferred ion guide or ion trap to then be accelerated out of the preferred ion guide or ion trap.

FIG. 4 shows a plot of the DC potentials of each segment of a preferred ion guide or ion trap according to another embodiment wherein ions which have succeeded in escaping from the central axial ion trapping region are then preferably accelerated out of the preferred ion guide or ion trap.

According to this embodiment the potential of segments ±15 to 20 progressively decreases. The DC potentials of all the segments ±15 to 20 preferably remain substantially constant as a function of time although less preferably it is contemplated that these potentials could vary with time.

Figure 5:
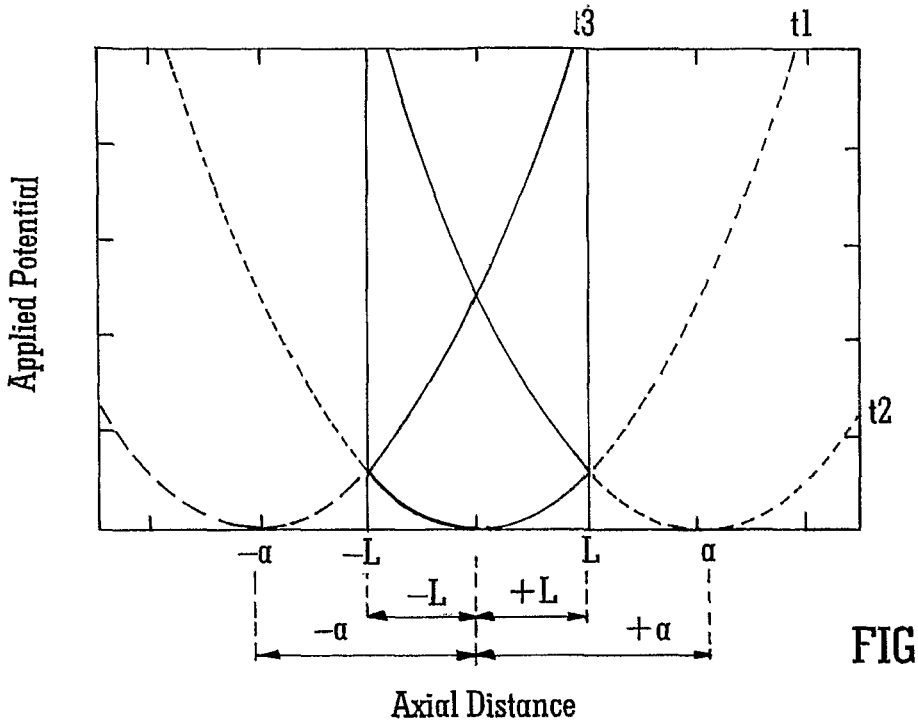
FIG. 5 shows the axial DC potential profile maintained over the axial ion trapping region of a preferred ion guide or ion trap at three different times according to an embodiment.

FIG. 5 illustrates the general principles of how ions may be non-resonantly ejected from the preferred ion guide or ion trap by modulating the position the axial quadratic potential well according to the preferred embodiment of the present invention. FIG. 5 shows the quadratic DC or electrostatic axial potential profile as maintained along the trapping region of a preferred ion guide or ion trap at three different times t1, t2 and t3. The boundaries of the central axial ion trapping region are indicated by axial positions ±L. It is to be noted that only potentials as shown within the region −L to L are actually applied to the electrodes of the preferred ion guide or ion trap. The potentials shown by dashed lines at distances less than −L and greater than L are not actually applied to the electrodes of the preferred ion guide or ion trap.

The axial potential profile at a first time t1 as shown in FIG. 5 corresponds with an axial quadratic DC potential well being maintained along a preferred ion guide or ion trap wherein the minimum of the quadratic potential well is located at the centre or middle of the preferred ion guide or ion trap. The DC potentials of the segments of the preferred ion guide or ion trap corresponding to the axial ion trapping region are preferably continuously varied with time so that the minimum of the DC quadratic axial potential well is preferably translated in a first direction with time. The minimum of the DC quadratic potential well is preferably translated along the axis of the preferred ion guide or ion trap until the minimum of the DC quadratic potential well reaches a maximum positive displacement of +a at a subsequent time t2 as shown in FIG. 5. The potentials of the segments of the preferred ion guide or ion trap are then preferably varied with time so that the minimum of the DC quadratic axial potential well is then preferably translated back in a second opposed direction along the axis of the preferred ion guide or ion trap until the minimum of the DC potential well reaches a maximum negative displacement of −a at a yet later time t3 as also shown in FIG. 5.

The position of the DC axial quadratic potential well is preferably continuously varied or modulated in the manner as described above such that the minimum of the DC axial potential well is preferably caused to oscillate about a predetermined position which is preferably the centre or middle of the preferred ion guide or ion trap.

According to the embodiment discussed above with reference to FIG. 5 only the potentials of the axial segments located between the boundaries ±L defining the central axial ion trapping region are preferably modulated in this manner. The potentials of the electrodes beyond the boundaries of the central axial ion trapping region located at ±L preferably remain substantially constant with time.

The electric field $E_z$ maintained across the central axial ion trapping region in the axial or z-direction is preferably given by:

$$E_z(t) = \frac{\delta U_z}{\delta z} = k \cdot [z + a\cos(\Omega \cdot t)] \tag{9}$$

Figure 6:
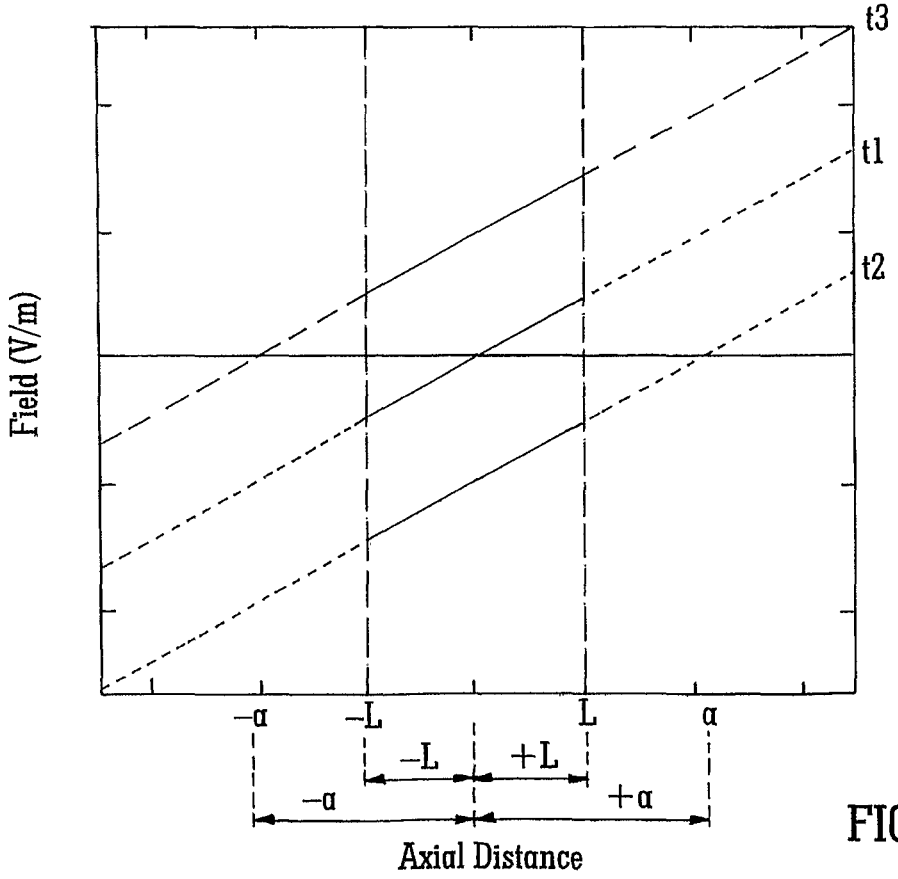
FIG. 6 shows the axial electric field maintained along the axial ion trapping region of a preferred ion guide or ion trap at the same three different times according to an embodiment.

FIG. 6 shows the axial electric field as maintained across the central axial ion trapping region of the preferred ion guide or ion trap (and as described by Equation 9 above) at times t1, t2 and t3.

The axial electric field indicated by t1 in FIG. 6 represents the axial electric field maintained across the central axial ion trapping region at a time t1 when the minimum of the quadratic potential well is located at the centre or middle of the axial ion trapping region or the preferred ion guide or ion trap. The axial electric field indicated by t2 in FIG. 6 represents the axial electric field maintained across the central axial ion trapping region at a time t2 when the minimum of the quadratic potential well is located at the position +a (i.e. beyond the central axial ion trapping region). The axial electric field indicated by t3 in FIG. 6 represents the axial electric field maintained across the central axial ion trapping region at a time t3 when the minimum of the quadratic potential well is located at the position −a (i.e. also beyond the central axial ion trapping region). Accordingly, it is apparent from FIG. 6 that a linear axial electric field is preferably provided across the axial ion trapping region which can be considered as having an offset which changes with time.

Figure 7:
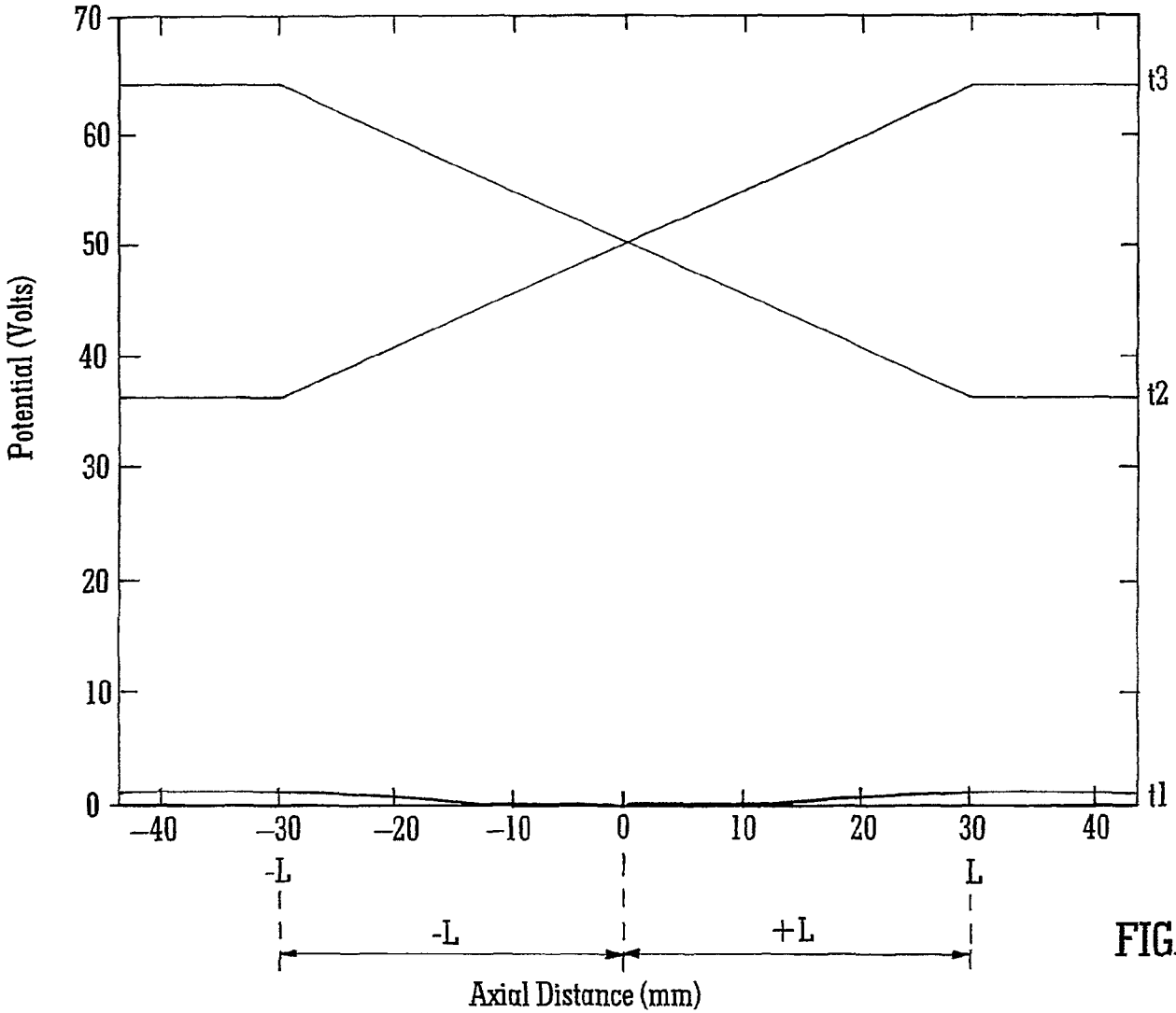
FIG. 7 shows an example of the axial DC potential profile maintained along an ion guide or ion trap at three different times according to an embodiment.

FIG. 7 shows a graph of the axial DC potential profile maintained along an ion guide or ion trap at times t1, t2 or t3 during modulation of the minimum of an axial quadratic DC potential well according to a specific example. In this particular example the axial potential is maintained constant beyond the central axial ion trapping region defined by boundaries located at an axial distance of ±L. The boundary of the central axial ion trapping potential ±L was set at ±29 mm and the maximum displacement ±a of the minimum of the axial quadratic DC potential well was set at ±203 mm (i.e. well outside the central axial ion trapping region).

The curve indicated as t1 in FIG. 7 represents the axial DC potential profile maintained along the preferred ion guide or ion trap at time t1 when the minimum of the quadratic DC axial potential well is located at the centre or middle of the central axial ion trapping region. The curve indicated as t2 represents the potential profile maintained along the preferred ion guide or ion trap at a subsequent time t2 when the minimum of the quadratic DC axial potential well is located at a position +a. The curve indicated as t3 represents the potential profile maintained along the preferred ion guide or ion trap at a yet later time t3 when the minimum of the quadratic DC axial potential well is located at a position −a.

The force $F_z$ on an ion in the z-direction within the central axial ion trapping region is given by:

$$F_z(t)=-q\cdot E_z(t)=-q\cdot k\cdot[z+a\cos(\Omega\cdot t)] \tag{10}$$

The acceleration $A_z$ of an ion within the axial ion trapping region along the axial direction or z-axis is given by:

$$\begin{aligned} A_z &= \ddot{z} \\ &= -\frac{q}{m}\cdot k\cdot[z+a\cos(\Omega\cdot t)] \end{aligned} \tag{11}$$

The equation of motion of an ion in the axial direction within the central axial ion trapping region is given by:

$$\ddot{z}+\frac{q}{m}\cdot k\cdot z=-\frac{q}{m}\cdot k\cdot a\cos(\Omega\cdot t) \tag{12}$$

As will be appreciated by those skilled in the art, this equation of motion describes a forced linear harmonic oscillator. The exact solution is:

$$z(t)=z_1\cos(\omega\cdot t)+\sqrt{(2\cdot V/k)}\cdot\sin(\omega\cdot t)+\frac{q\cdot k\cdot a}{m(\omega^2-\Omega^2)}[\cos(\Omega\cdot t)-\cos(\omega\cdot t)] \tag{13}$$

wherein $z_1$ is the initial z coordinate of an ion at t=0, V is the initial kinetic energy of the ion in the z-direction at t=0, $\omega=\sqrt{q\cdot k/m}$ and is the fundamental frequency of simple harmonic motion of the ion, a is the amplitude of the modulation of the quadratic potential well in the axial z-direction and Ω is the frequency of the modulation of the axial quadratic potential well.

This solution considers that the amplitude of the modulation of the DC axial quadratic potential well is at a maximum at t=0. Different solutions may be found if the modulation of the axial field is started at differing phase angles. Equation 13 can be rewritten as:

$$z(t)=z_1\cos(\omega\cdot t)+\sqrt{(2\cdot V/k)}\cdot\sin(\omega\cdot t)-\frac{2\cdot q\cdot k\cdot a}{m(\omega^2-\Omega^2)}\cdot\sin(\varpi_1\cdot t)\cdot\sin(\varpi_2\cdot t) \tag{14}$$

wherein:

$$\varpi_1=\frac{\Omega+\omega}{2}$$

$$\varpi_2=\frac{\Omega-\omega}{2}$$

From Equation 14 it can be seen that ions trapped within the central axial ion trapping region will oscillate with a combination of frequencies which are independent of the initial kinetic energy V and starting position z1 of the ions. These frequencies are the fundamental harmonic frequency ω, and frequencies $\overline{\omega}_1$ and $\overline{\omega}_2$ as defined above.

FIGS. 8A-8C show plots of the amplitude of ion oscillations in the axial direction for ions having mass to charge ratios of 200, 300 and 400 respectively. The position of the DC axial quadratic potential well is modulated as described above in relation to the specific example described with reference to FIG. 7.

The motion of ions is governed by Equation 13 derived above. For this particular example the field constant k for the quadratic axial DC potential well was set to 2378 V/m$^2$. The maximum axial displacement ±a of the minimum of the quadratic potential well was set to ±202 mm. The quadratic axial DC potential well was modelled as being oscillated or modulated at a frequency Ω of $1.4\times10^5$ radians per second (22.3 kHz). The ions were modelled as starting from an initial position z1 equal to 0 mm and possessing an initial energy V equal to 0 eV.

It can be seen from FIGS. 8A-8C that ions having a lower mass to charge ratio (see e.g. FIG. 8A which relates to ions having a mass to charge ratio of 200) have a corresponding higher amplitude of oscillation compared to ions having a lower mass to charge ratio (see e.g. FIG. 8C which relates to ions having a mass to charge ratio of 400). It can also be seen from FIGS. 8A-8C that relative high frequency motion at frequencies $\overline{\omega}_1$ and $\overline{\omega}_2$ due to high frequency modulation of the DC axial quadratic potential well is superimposed upon a characteristically lower frequency simple harmonic motion occurring at the fundamental resonance frequency ω.

The equation of motion represented by Equation 12 above considers the motion of an ion wherein the maximum axial displacement ±a of the minimum of the axial quadratic potential well is fixed and wherein the frequency of modulation Ω of the axial quadratic potential well is also fixed. It is possible to consider the case where the frequency of modulation Ω of the axial DC quadratic potential well is constant and is greater than the fundamental resonance frequency ω of the ions and wherein the maximum axial displacement (a) of the quadratic axial potential well is progressively increased linearly with time. Under these conditions a new equation of motion can be formulated:

$$A_z = \ddot{z} = -\frac{q}{m}\cdot k\cdot[z + a\cdot t\cdot\cos(\Omega\cdot t)] \tag{15}$$

The solution to this equation is given by:

$$z(t) = z_1\cos(\omega\cdot t) + \left[\sqrt{(2\cdot V/k} - \frac{.2\cdot q\cdot k\cdot a\cdot\Omega^2}{m\cdot\omega\cdot(\omega^2-\Omega^2)^2}\right]\cdot\sin(\omega\cdot t) + \frac{q\cdot k\cdot a\cdot t}{m(\omega^2-\Omega^2)}\cdot\cos(\Omega\cdot t) + \frac{2\cdot q\cdot k\cdot a\cdot\Omega}{m\cdot(\omega^2-\Omega^2)^2}\cdot\sin(\Omega\cdot t) \tag{16}$$

Equation 16 therefore describes the motion of ions during an analytical scan in which the maximum axial displacement of the minimum of the quadratic axial potential well is progressively increased. According to an embodiment such an analytical scan can be performed over a time period of several milliseconds in order to non-resonantly eject ions from the preferred ion guide or ion trap. Such an embodiment will be described in more detail below.

FIGS. 9A-9C show plots of the amplitude of oscillation of ions in the axial direction versus time for ions having mass to charge ratios of 200, 300 and 400 respectively wherein the maximum axial displacement of the minimum of the axial quadratic potential well is progressively linearly increased with time. The ion motion is governed by Equation 16 as discussed above. The field constant k for the quadratic axial potential was set to 2378 V/m$^2$. The maximum axial displacement ±a of the minimum of the axial quadratic potential well was scanned or progressively increased from 0 to 400 mm over a time period of 8 ms. The frequency of modulation of the axial quadratic potential well was fixed at a frequency Ω of $1\times10^5$ radians per second (16 kHz). The ions were modelled as starting at an initial position z1 equal to 0.1 mm and with an initial energy V equal to 0 eV.

It can be seen from comparing FIGS. 9A-9C that as the maximum axial displacement of the minimum of the axial quadratic potential well progressively increases with time then so the maximum amplitude of oscillations of the ions in the axial direction also correspondingly increases. It is also apparent from comparing FIGS. 9A-9C that ions having a relatively low mass to charge ratio (see e.g. FIG. 9A which relates to ions having a mass to charge ratio of 200) have a higher amplitude of oscillation than ions having a relatively high mass to charge ratio (see e.g. FIG. 9C which relates to ions having a mass to charge ratio of 400) for the same maximum axial displacement of the minimum of the axial quadratic potential well. Accordingly, ions having a relatively low mass to charge ratio will be ejected from the central axial ion trapping region of the preferred ion guide or ion trap before ions having relatively higher mass to charge ratio according to the preferred embodiment of the present invention.

FIG. 10 shows a plot of the scan function used in the embodiment described above with reference to FIGS. 9A-9C in order to non-resonantly eject ions from the preferred ion guide or ion trap. The y-axis shows the maximum axial displacement of the minimum of the DC axial quadratic potential well and the x-axis shows the time. In this particular embodiment the maximum axial displacement of the minimum of the DC axial quadratic potential well was progressively increased linearly with time from 0 mm to 400 mm over a period of 8 ms.

It will be understood by those skilled in the art that the application of an axial DC electrostatic voltage will also result in a radial electrostatic potential being generated within the preferred ion guide or ion trap. To illustrate this effect an ion a segmented cylinder may be considered. Considering a quadratic potential of the form:

$$U_z(t) = \frac{k\cdot[z + a\cos(\Omega t)]^2}{2} \tag{17}$$

which is superimposed along the axis of the cylinder, then the potential in x,y,z is given by:

$$U_{z,x,y}(t) = k\left([z + z\cos(\Omega t)]^2 - \frac{(x^2+y^2)}{2} + \frac{r_0^2}{2}\right) \tag{18}$$

wherein $r_0$ is the radius of the cylinder.

Equation 18 satisfies the Laplace condition given by:

$$\frac{\delta^2 z}{\delta x^2} + \frac{\delta^2 x}{\delta x^2} + \frac{\delta^2 y}{\delta y^2} = 0 \tag{19}$$

It can therefore be seen from Equation 18 that by superimposing an axially modulated quadratic DC potential along the axis of the cylinder, a static radial field is also produced which exerts a force on the ions in a direction away from the central axis of the cylinder towards the outer electrodes. However, provided that the radial pseudo-potential well created by the application of an AC or RF voltage to the outer electrodes is sufficient to overcome the radial force exerted on ions due to the axially modulated quadratic potential, then the ions will remain radially confined.

Ions will only be axially contained or confined within the ion trapping region of the preferred ion guide or ion trap when the amplitude of oscillations of the ions is such so that the ions remain within the boundaries ±L of the central axial ion trapping region of the preferred ion guide or ion trap. This condition may be used to define conditions of stable ion trapping within the preferred ion guide or ion trap. If an additional linear axial DC potential $DC_z$ is applied across the axial ion trapping region of the form:

$$DC_z = b\cdot z \tag{22}$$

then the position of the minimum of the axial quadratic potential well will then be displaced thereby altering the amplitude of oscillation at which ions will become unstable. This method can therefore also be used to progressively scan ions out of the preferred ion trap.

A stability diagram for the preferred ion guide or ion trap may be generated in terms of the variables a, b, k, m, Ω and L wherein L is the distance from the minimum of the axial quadratic potential well to each boundary of the central axial ion trapping region.

FIG. 11 shows the stability diagram for the preferred ion guide or ion trap with regions of stability and instability indicated. The y-axis represents the normalised magnitude of the axial displacement of the minimum of the mean axial potential resulting from application of a static linear potential $DC_z$. The x-axis represents normalised amplitude of oscillation. The region of the stability diagram labelled Z Stable indicates that ions are stable and remain trapped within the preferred ion guide or ion trap. The regions labelled Unstable indicate that ions do not remain trapped and preferably leave the preferred ion guide or ion trap. The region labelled +Z Unstable indicates that ions will preferably leave the preferred ion guide or ion trap from one end of the preferred ion guide or ion trap. Similarly, the region labelled −Z Unstable indicates that ions will preferably leave the preferred ion guide or ion trap from the other end of the preferred ion guide or ion trap. The region labelled ±Z Unstable indicates that ions will preferably leave the preferred ion guide or ion trap from both ends.

The stability diagram shown in FIG. 11 assumes that ions have first been subject to collisional cooling within the preferred ion guide or ion trap such that the amplitude of their oscillations is predominantly governed by the amplitude of their high frequency motion which is due, for example, to modulation of the position of the quadratic potential well rather than by the amplitude of the lower frequency harmonic motion within the axial electrostatic or DC quadratic potential well.

The expression for the normalised amplitude of oscillation can be modified to include different starting conditions including different initial energies V and different initial position terms z1 for the ions. The expression can also be modified to include the initial starting phase of the modulation of the axial quadratic potential well.

The motion of ions within the axial ion trapping region of the preferred ion guide or ion trap may be modified by the introduction of a collisional damping gas into the preferred ion guide or ion trap. The equation of motion in the presence of a damping gas is given as:

$$\ddot{z} + \lambda\dot{z} + \frac{q}{m}\cdot k\cdot z = \frac{q}{m}\cdot k\cdot a\cos(\Omega\cdot t) \tag{23}$$

wherein λ is the damping constant and is a function of the mobility of the ions.

Ion mobility is a function of the ion cross-sectional area, the damping gas number density, the ion charge, the masses of the ion and the gas molecules, and the temperature. Hence, in the presence of a damping gas the equation of motion will also be dependent upon the mobility of the ions. Accordingly, in these circumstances the conditions for stable and unstable ion motion will also be dependent upon the ion mobility. New equations of motion and stability diagrams can therefore be generated for different damping conditions and ions can be separated according to their ion mobility as well as according to their mass to charge ratio.

In the preferred embodiment the DC voltage applied to each individual segment of the preferred ion guide or ion trap is preferably generated using individual low voltage power supplies. The outputs of the DC power supplies are preferably controlled by a programmable microprocessor. The general form of the electrostatic potential function in the axial direction can preferably be rapidly manipulated and complex and/or time varying potentials can be superimposed along the axial direction of the preferred ion guide or ion trap.

In the preferred embodiment ions are preferably introduced into the preferred ion guide or ion trap from an external ion source either in a pulsed or a substantially continuous manner. During the introduction of a continuous beam of ions from an external ion source, the initial axial energy of the ions entering the preferred ion guide or ion trap may be preferably arranged such that all ions having mass to charge ratios within a desired range are preferably radially confined within the preferred ion guide or ion trap by the application of an AC or RF voltage to the electrodes. The ions also preferably become trapped axially by superimposed axial electrostatic potentials. The initial trapping DC or electrostatic potential function in the axial direction may or may not be quadratic and the minimum of the axial DC trapping potential may or may not correspond to the centre or middle of the preferred ion guide or ion trap. As ions are introduced into the preferred ion guide or ion trap the amplitude of the modulation of the axial quadratic DC potential well may preferably initially beset to zero.

The initial trapping of ions within the preferred ion guide or ion trap may be accomplished in the absence of a cooling gas or alternatively it may be accomplished in the presence of a cooling gas.

Once the ions are confined within the axial ion trapping region of the preferred ion guide or ion trap their initial energy spread may be preferably reduced either by introducing a cooling gas into the ion confinement or axial ion trapping region or by the presence of cooling gas which is already present within the axial ion trapping region. The cooling gas may preferably be maintained at a pressure in the range of $10^{-4}$ to $10^{1}$ mbar, more preferably in the range of $10^{-3}$ to $10^{-1}$ mbar. The kinetic energy of the ions will be preferably lost in collisions with the cooling gas molecules and the ions will preferably reach thermal energies. Collisions with residual gas molecules will preferably eventually cause the amplitude of the oscillations of the ions to decrease and hence ions will tend to collapse towards the centre or minimum of the axial DC potential well. However, although ions will lose energy they will not be lost from the preferred ion guide or ion trap as they will remain confined by the radial pseudo-potential well. Accordingly, the preferred ion guide or ion trap is particularly advantageous compared to other ion traps such as orbitraps wherein ions will be lost to the system if they lose sufficient energy due to collisions with gas molecules. For this reason orbitraps have to be operated at an Ultra High Vacuum (UHV) which is disadvantageous.

According to the preferred embodiment, ions of differing mass to charge ratios are preferably made to migrate along the axis of the preferred ion guide or ion trap to the point of lowest electrostatic potential so that the spatial spread and energy range of the ions is preferably minimised.

According to an embodiment once the ions have been thermally cooled and are preferably located at the minimum of the axial potential well, the position of the axial quadratic potential well may then be modulated and the amplitude of oscillations may be increased. The frequency of the modulation of the axial quadratic potential well is preferably maintained above the fundamental resonance frequency of the ions.

According to an embodiment mass selective ejection of ions may then be commenced in a non-resonant manner by progressively increasing the amplitude of the axial modulation of the minimum of the axial quadratic potential well whilst keeping the modulation frequency Ω substantially constant.

According to an alternative embodiment, mass selective ejection of ions from the preferred ion guide or ion trap may be achieved by keeping the amplitude of modulation of the axial quadratic potential well constant and by progressively decreasing the frequency Ω of the modulation of the axial quadratic potential well.

According to another embodiment, mass selective ejection from the preferred ion guide or ion trap may be achieved by varying both the amplitude of and the frequency Ω of the axial modulation of the axial quadratic potential well.

In a less preferred mode of operation both the frequency and the amplitude of the axial modulation of the axial quadratic potential well may be fixed and instead the mean position of the minimum of the axial potential well may be moved relative to the physical dimensions of the preferred ion guide or ion trap. Ions having relatively low mass to charge ratios will have higher amplitudes of motion in the axial direction and hence will preferably be ejected from the preferred ion guide or ion trap before ions having relatively high mass to charge ratios.

In another less preferred mode of operation the frequency and amplitude of the axial modulation of the axial quadratic potential well is also preferably fixed and the position of the minimum of the time averaged electrostatic potential is also preferably fixed. According to this embodiment the field constant k of the axial quadratic electrostatic potential well is then preferably progressively lowered. In this embodiment ions having relatively low mass to charge ratios will be ejected from the preferred ion guide or ion trap before ions having relatively high mass to change ratios.

In an embodiment the minimum of the axial quadratic potential well may be displaced from the centre of the preferred ion guide or ion trap so that ions are preferably ejected from one end only of the preferred ion guide or ion trap.

Ions which are ejected from the preferred ion guide or ion trap may be subsequently detected using an ion detector. The ion detector may comprise an ion detector such as a microchannel plate (MCP) ion detector, a channeltron or discrete dynode electron multiplier or a conversion dynode detector. Phosphor or scintillator detectors and photo multipliers may also be used. Alternatively, ions ejected from the preferred ion guide or ion trap may be onwardly transmitted to a collision gas cell or another component of a mass spectrometer. According to an embodiment ions ejected from the preferred ion guide or ion trap may be mass analysed by a mass analyser such as a Time of Flight mass analyser or a quadrupole mass analyser.

In addition to the mass selective instability modes of operation described above, according to other embodiments the preferred ion guide or ion trap may in a mode of operation also advantageously be operated in a known manner wherein, for example, ions are resonantly ejected axially from the preferred ion guide or ion trap.

According to an embodiment ions may be resonantly excited at their fundamental harmonic frequency but may not be excited sufficiently such that they exit the preferred ion guide or ion trap. Instead, ions may be caused to be ejected from the preferred ion guide or ion trap due to the additional effect due to modulation of the axial quadratic potential well preferably at a frequency substantially higher than the fundamental resonance frequency of the ions.

According to an embodiment the amplitude of ion oscillation may be increased by increasing the amplitude of the axial modulation of the axial quadratic potential well or by decreasing the frequency of the axial modulation Ω of the axial quadratic potential well as described above. However, at a time before ions of a specific mass to charge ratio are actually ejected from the preferred ion guide or ion trap, a small amount of resonance excitation may be applied at a frequency corresponding to the fundamental resonance frequency ω of the ions desired to be ejected in order to increase their amplitude of oscillation. However, although the ions are partially excited in a resonant manner the ions are actually caused to be ejected from the preferred ion guide or ion trap due to non-resonant excitation.

In addition to a MS mode of operation as described above the preferred ion guide or ion trap may also be used for MS″ experiments wherein ions are fragmented and the resulting daughter or fragment ions are then mass analysed. In the preferred embodiment wherein the preferred ion guide or ion trap comprises a segmented quadrupole rod set, parent or precursor ions of interest having a specific mass to charge ratio may be selected using the well-known radial stability characteristics of the RF quadrupole. In particular, application of a dipolar resonance voltage or a resolving DC voltage may be used to reject ions having a specific mass to charge ratio either as ions enter the quadrupole or once they have been initially trapped within the quadrupole rod set.

In another embodiment precursor or parent ions may be selected by axial resonance ejection from the axial potential well. In this case a broad band of excitation frequencies may be applied simultaneously to the electrodes forming the axial trapping system. All ions with the exception of the desired precursor or parent ion to be subsequently analysed are then preferably caused to be ejected from the preferred ion guide or ion trap. The method of inverse Fourier transform may be employed to generate the waveform suitable for resonance ejection of a broad range of ions whilst leaving ions having a specific desired mass to charge ratio within the preferred ion guide or ion trap.

In another embodiment precursor or parent ions may be selected using a combination of axial resonance ejection from the axial electrostatic potential well together with mass selective non-resonant ejection according to the preferred embodiment of the present invention.

Once desired precursor or parent ions have been isolated in the preferred ion guide or ion trap, collision gas may then be preferably introduced or reintroduced into the preferred ion guide or ion trap. Fragmentation of the selected precursor or parent ions may then be accomplished by increasing the amplitude of oscillation of the ions and therefore the velocity of the ions. This may be achieved by increasing the amplitude of oscillation of the axial quadratic potential well, decreasing the frequency Ω of axial modulation of the electrostatic quadratic potential well or by superimposing an excitation waveform at a frequency corresponding to the fundamental harmonic frequency ω of the precursor or parent ions.

According to an alternative embodiment fragmentation may be accomplished by increasing the amplitude of oscillation of the precursor or parent ions and therefore the velocity of the ions in the radial direction. This may be achieved by altering the frequency or amplitude of the AC or RF voltage applied to the quadrupole rods or electrodes forming the preferred ion guide or ion trap or by superimposing a dipolar excitation waveform in the radial direction to one pair of quadrupole rods which has a frequency matching the secular frequency characteristic of the ions of interest. A combination of any of these techniques may be used to excite desired precursor or parent ions thereby causing them to possess sufficient energy such that they are then caused to fragment. The resulting fragment or daughter ions may then be mass analysed by any of the methods described above.

The process of selecting ions and exciting them may be repeated to allow MS″ experiments to be performed. The resulting MS″ ions may then be axially ejected from the preferred ion guide or ion trap using the methods previously described.

According to other embodiments a monopole, hexapole, octapole or a higher order multi-pole ion guide or ion trap may be utilised for radial confinement of ions. Higher order multi-poles are particularly advantageous in that they have a higher order pseudo-potential well function. When a higher order multi-pole ion guide or ion trap is used in a resonance ejection mode of operation, the higher order fields within such non-quadrupolar devices reduce the likelihood of radial resonance losses. In non-linear radial fields the frequency of the radial secular motion is related to position of the ions and hence ions will go out of resonance before they are ejected. Furthermore, the base of the pseudo-potential well generated within a higher order multi-pole ion guide is broader than that of a quadrupole and hence non-quadrupolar devices potentially possess a higher capacity for charge. Therefore, such devices offer the possibility of improved overall dynamic range. The rods of multi-pole ion guides or ion traps according to embodiments of the present invention may have hyperbolic, circular, arcuate, rectangular or square cross-sections. Other cross-sectional shapes may also be used according to less preferred embodiments.

In an embodiment a periodic function other than that described by cosine or sine functions may be utilised for voltage modulation and hence modulation of the position of the quadratic axial potential well. For example, voltages may be stepped between maximum values using digital programming.

According to another embodiment the ion guide or ion trap may comprise a continuous rod set rather than a segmented rod set. According to such an embodiment the rods may comprise a non-conducting material (e.g. a ceramic or other insulator) and may be coated with a non-uniform resistive material. The application of a voltage between, for example, the centre of the rods and the ends of the rods will result in an axial DC potential well being generated along the axial ion trapping region of the preferred ion guide or ion trap.

According to an embodiment a desired axial DC potential profile may be developed at each segment of the preferred ion guide or ion trap using a series of fixed or variable resistors between the individual segments or electrodes of the preferred ion guide or ion trap.

In another embodiment a desired axial DC potential profile may be provided by one or more auxiliary electrodes which may be arranged around or alongside the electrodes forming the preferred ion guide or ion trap. The one or more auxiliary electrodes may, for example, comprise a segmented electrode arrangement, one or more resistively coated electrodes, or other suitably shaped electrodes. Application of a suitable voltage or voltages to the one or more auxiliary electrodes preferably causes a desired axial DC potential profile to be maintained along the axial ion trapping region of the preferred ion guide or ion trap.

In an embodiment the preferred ion guide or ion trap may comprise an AC or RF ring stack arrangement comprising a plurality of electrodes having circular or non-circular apertures through which ions are transmitted in use. An ion tunnel arrangement may, for example, be used for radial confinement of the ions. In such an embodiment an AC or RF voltage of alternating polarity is preferably applied to adjacent annular rings of the ion tunnel device in order to generate a radial pseudo-potential well for radially confining the ions. An axial potential may be preferably superimposed along the length of ion tunnel ion guide or ion trap.

In another embodiment radial confinement of ions may be achieved using an ion guide comprising a stack of plates or planar electrodes wherein opposite phases of an AC or RF voltage are applied to adjacent plates or electrodes. Plates or electrodes at the top and bottom of such a stack of plates or electrodes may be supplied with a DC and/or RF trapping voltage so that an ion trapping volume is formed. The confining plates or electrodes may themselves be segmented thereby allowing an axial trapping electrostatic potential function to be superimposed along the length of the preferred ion guide or ion trap and so that mass selective axial ejection of ions may be performed using the methods according to the preferred embodiment.

According to an embodiment multiple axial DC potential wells may be maintained or formed along the length of the preferred ion guide or ion trap. By manipulating the superimposed DC potentials applied to the electrode segments, ions may be caused to be trapped in one or more specific axial ion trapping regions. Ions trapped within a DC potential well in a specific region of a preferred ion guide or ion trap may then, for example, be subjected to mass selective ejection causing one or more ions to leave that potential well. Those ions ejected from one potential well may then be subsequently trapped in a second or different potential well within the same preferred ion guide or ion trap. This type of operation may be utilised, for example, to study ion-ion interactions. In this mode of operation ions may be introduced from either or both ends of the preferred ion guide or ion trap substantially simultaneously.

According to an embodiment ions trapped in a first potential well may be subjected to a resonance ejection condition which preferably causes only ions having a certain mass to charge ratio or certain range of mass to charge ratios to be ejected from the first potential well. Ions ejected from the first potential well then preferably pass to a second potential well. Resonance excitation may then be performed in the second potential well in order to fragment these ions. The resulting daughter or fragment ions may then be sequentially resonantly ejected from the second potential well for subsequent axial detection. Repeating this process enables MS/MS analysis of all the ions within the first potential well to be performed or recorded with substantially 100% efficiency.

According to further embodiments more than two potential wells may be maintained along an axial ion trapping region within the preferred ion guide or ion trap thereby allowing increasingly complex experiments to be realised. Alternatively, this flexibility may be used to condition the characteristics of ion packets for introduction to other analysis techniques.

In the present application it is understood that conventionally ions are resonantly ejected by exciting the ions at the first or fundamental resonance frequency. However, it is also contemplated that according to a mode of operation ions may be resonantly excited or ejected from a preferred ion guide or ion trap by exciting the ions at second or higher order harmonics of the fundamental resonance frequency. The present invention is intended to cover embodiments wherein the position of the one or more quadratic potential wells provided along the length of the ion guide or ion trap is modulated at frequencies which are greater than the first or fundamental resonance frequency or frequencies of the ions contained within the quadratic potential well or ion guide or ion trap. The frequency of modulation of the one or more quadratic potential wells may or may not correspond with a second or higher harmonic frequency or frequencies of the fundamental resonance frequency of the ions within the quadratic potential well or ion guide or ion trap.

Although the present invention has been described with reference to preferred embodiments, it will be understood by those skilled in the art that various changes in form and detail may be made without departing from the scope of the invention as set forth in the accompanying claims.

The invention claimed is:

1. An ion guide or ion trap comprising:

a plurality of electrodes;

an RF voltage source applying an RF voltage to at least some of said plurality of electrodes in order to confine radially at least some ions within said ion guide or ion trap;

a voltage supply maintaining one or more substantially quadratic potential wells along at least a portion of the axial length of said ion guide or ion trap in a first mode of operation, said one or more substantially quadratic potential wells having a minimum;

a modulator oscillating the position of said one or more substantially quadratic potential wells in a substantially periodic manner about a reference point and along at least a portion of the axial length of said ion guide or ion trap wherein said modulator is arranged and adapted to oscillate the position of said one or more substantially quadratic potential wells with or at a first frequency $f_1$, wherein said first frequency $f_1$ is greater than the resonance or fundamental harmonic frequency of at least 5% of the ions located within an ion trapping region within said ion guide or ion trap; and an ejector in said first mode of operation ejecting at least some ions from a trapping region of said ion guide or ion trap in a substantially non-resonant manner whilst other ions are arranged to remain substantially trapped within said trapping region of said ion guide or ion trap.

2. An ion guide or ion trap as claimed in claim 1, wherein said voltage supply is arranged and adapted to maintain one or more substantially quadratic potential wells along at least 1%, 5%, 10%, 20%, 30%, 40%, 50%, 60%, 70%, 80%, 90%, 95% or 100% of the axial length of said ion guide or ion trap.

3. An ion guide or ion trap as claimed in claim 1, wherein said voltage supply comprises one or more DC voltage supplies for supplying one or more DC voltages to at least 1%, 5%, 10%, 20%, 30%, 40%, 50%, 60%, 70%, 80%, 90%, 95% or 100% of said electrodes.

4. An ion guide or ion trap as claimed in claim 1, wherein said voltage supply is arranged and adapted to provide one or more substantially quadratic potential wells wherein the axial potential increases substantially as the square of the distance or displacement away from the minimum or centre of the potential well.

5. An ion guide or ion trap as claimed in claim 1, wherein the one or more potential wells are DC potential wells, and wherein said modulator comprises one or more DC voltage supplies for supplying one or more DC voltages to at least 1%, 5%, 10%, 20%, 30%, 40%, 50%, 60%, 70%, 80%, 90%, 95% or 100% of said electrodes.

6. An ion guide or ion trap as claimed in claim 1, wherein said modulator is arranged and adapted to continually oscillate the position of said one or more quadratic potential wells in a substantially periodic manner.

7. An ion guide or ion comprising:

a plurality of electrodes;

an RF voltage source applying an RF voltage to at least some of said plurality of electrodes in order to confine radially at least some ions within said ion guide or ion trap;

a voltage supply maintaining one or more substantially quadratic potential wells along at least a portion of the axial length of said ion guide or ion trap in a first mode of operation, said one or more substantially quadratic potential wells having a minimum;

a modulator oscillating the position of said one or more substantially quadratic potential wells in a substantially periodic manner about a reference point and along at least a portion of the axial length of said ion guide or ion trap; and an ejector in said first mode of operation ejecting at least some ions from a trapping re ion of said ion guide or ion trap in a substantially non-resonant manner whilst other ions are arranged to remain substantially trapped within said trapping region of said ion guide or ion trap, wherein said ejector is arranged and adapted to vary the amplitude of the oscillation of the position of said one or more quadratic potential wells.

8. An ion guide or ion trap as claimed in claim 7, wherein said ejector is arranged and adapted to increase the amplitude of the oscillation of the position of said one or more quadratic potential wells.

9. An ion guide or ion comprising:

a plurality of electrodes:

an RF voltage source applying an RF voltage to at least some of said plurality of electrodes in order to confine radially at least some ions within said ion guide or ion trap;

a voltage supply maintaining one or more substantially quadratic potential wells along at least a portion of the axial length of said ion guide or ion trap in a first mode of operation, said one or more substantially quadratic potential wells having a minimum;

a modulator oscillating the position of said one or more substantially quadratic potential wells in a substantially periodic manner about a reference point and along at least a portion of the axial length of said ion guide or ion trap; and an ejector in said first mode of operation ejecting at least some ions from a trapping region of said ion guide or ion trap in a substantially non-resonant manner whilst other ions are arranged to remain substantially trapped within said trapping region of said ion guide or ion trap, wherein said ejector is arranged and adapted to vary the frequency of oscillation of the position of said one or more quadratic potential wells.

10. An ion guide or ion trap as claimed in claim 9, wherein said ejector is arranged and adapted to decrease the frequency of oscillation of the position of said one or more quadratic potential wells.

* * * * *